US008081886B2

(12) United States Patent
Okano

(10) Patent No.: US 8,081,886 B2
(45) Date of Patent: Dec. 20, 2011

(54) IMAGE FORMING APPARATUS WHICH MEMORIZES A PAPER JAM

(75) Inventor: Tetsuya Okano, Anjo (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 1176 days.

(21) Appl. No.: 11/882,160

(22) Filed: Jul. 31, 2007

(65) Prior Publication Data

US 2008/0037035 A1 Feb. 14, 2008

(30) Foreign Application Priority Data

Aug. 1, 2006 (JP) ..... 2006-209846

(51) Int. Cl.
*B65H 7/06* (2006.01)
*G03G 15/00* (2006.01)
*B41J 11/44* (2006.01)

(52) U.S. Cl. ..... 399/21; 400/76

(58) Field of Classification Search ..... 399/21
See application file for complete search history.

(56) References Cited

U.S. PATENT DOCUMENTS 6,118,962 A * 9/2000 Casper et al. ..... 399/119
2004/0197108 A1* 10/2004 Yamagata et al. ..... 399/21
2006/0145414 A1* 7/2006 Yokobori et al. ..... 271/258.01

FOREIGN PATENT DOCUMENTS

JP 6-48612 2/1994
JP 06-171794 A 6/1994
JP 08-106244 A 4/1996
JP 9-124185 5/1997
JP 2001-158566 A 6/2001
JP 2002-258689 9/2002

OTHER PUBLICATIONS

Machine translation of JP Publ. No. 09-124185 to Suda published on May 13, 1997.*
Machine translation of JP Publ. No. 06-171794 to Tsuchiya published on Jun. 21, 1994.*
Japanese Notice of Reasons for Refusal, w/ English translation thereof, issued in Patent Application No. JP 2006-209846 dated on Jul. 31, 2008.

* cited by examiner

*Primary Examiner* — Daniel J Colilla
*Assistant Examiner* — Blake A Tankersley
(74) *Attorney, Agent, or Firm* — McDermott Will & Emery LLP

(57) ABSTRACT

The present invention can include an image forming apparatus including a conveying device configured to convey a medium for recording along a conveyance path, an image forming portion configured to form an image on the medium for recording conveyed by the conveying device, a first medium detecting device configured to detect the presence and absence of the medium for recording at a first position in the conveyance path, a second medium detecting device configured to detect the presence and absence of the medium for recording at a second position in the conveyance path, and a storage device configured to store information on a state where after the medium for recording is detected by the first medium detecting device, the absence of the medium for recording is detected by the first medium detecting device, and then the medium for recording is not detected by the second medium recording detecting device.

12 Claims, 20 Drawing Sheets

IMAGE FORMING APPARATUS WHICH MEMORIZES A PAPER JAM

CROSS REFERENCE TO RELATED APPLICATION

This application claims priority from Japanese Patent Application No. 2006-209846 filed Aug. 1, 2006. The entire content of this priority application is incorporated herein by reference.

TECHNICAL FIELD

The present disclosure relates to an image forming apparatus.

BACKGROUND

Conventionally, there is provided a technique for detecting a paper jam in the field of image forming apparatus. In the technique, it is common practice to perform paper jam determination (jam determination) on the basis of whether or not a medium for recording being conveyed is moved between predetermined positions within a predetermined period of time.

The above described jam detection can be specifically performed by providing detecting devices for detecting a medium for recording at two positions in a conveyance path, respectively. For example, it is possible to determine that the paper jam is caused, when the medium for recording passes through one of the detecting devices and thereafter does not pass through the other detecting device within a predetermined period of time. However, in the case of the constitution in which the paper jam is determined on the basis of the detection by the two detecting devices, there is a problem that when the power supply of the image forming apparatus is interrupted in the state where the medium for recording is jammed between the two detecting devices, the redetection of the medium for recording cannot be performed. For example, when the power supply is interrupted in the state where the medium for recording is jammed between the two detecting devices, the paper jam cannot be detected because the medium for recording is not detected by any of the detecting devices when the power supply is turned on at the next time.

Thus, there is a need in the art for an image forming apparatus capable of suitably locating a medium for recording existing between two detecting devices.

SUMMARY

The present invention can include an image forming apparatus including a conveying device configured to convey a medium for recording along a conveyance path, an image forming portion configured to form an image on the medium for recording conveyed by the conveying device, a first medium detecting device configured to detect the presence and absence of the medium for recording at a first position in the conveyance path, a second medium detecting device configured to detect the presence and absence of the medium for recording at a second position in the conveyance path, and a storage device configured to store information on a state where after the medium for recording is detected by the first medium detecting device, the absence of the medium for recording is detected by the first medium detecting device, and then the medium for recording is not detected by the second medium recording detecting device.

BRIEF DESCRIPTION OF THE DRAWINGS

Illustrative aspects in accordance with the invention will be described in detail with reference to the following figures wherein.

DETAILED DESCRIPTION

Example structures according to the present invention will be described with reference to the accompanying drawings.

1. Constitution of Printer

Figure 1:
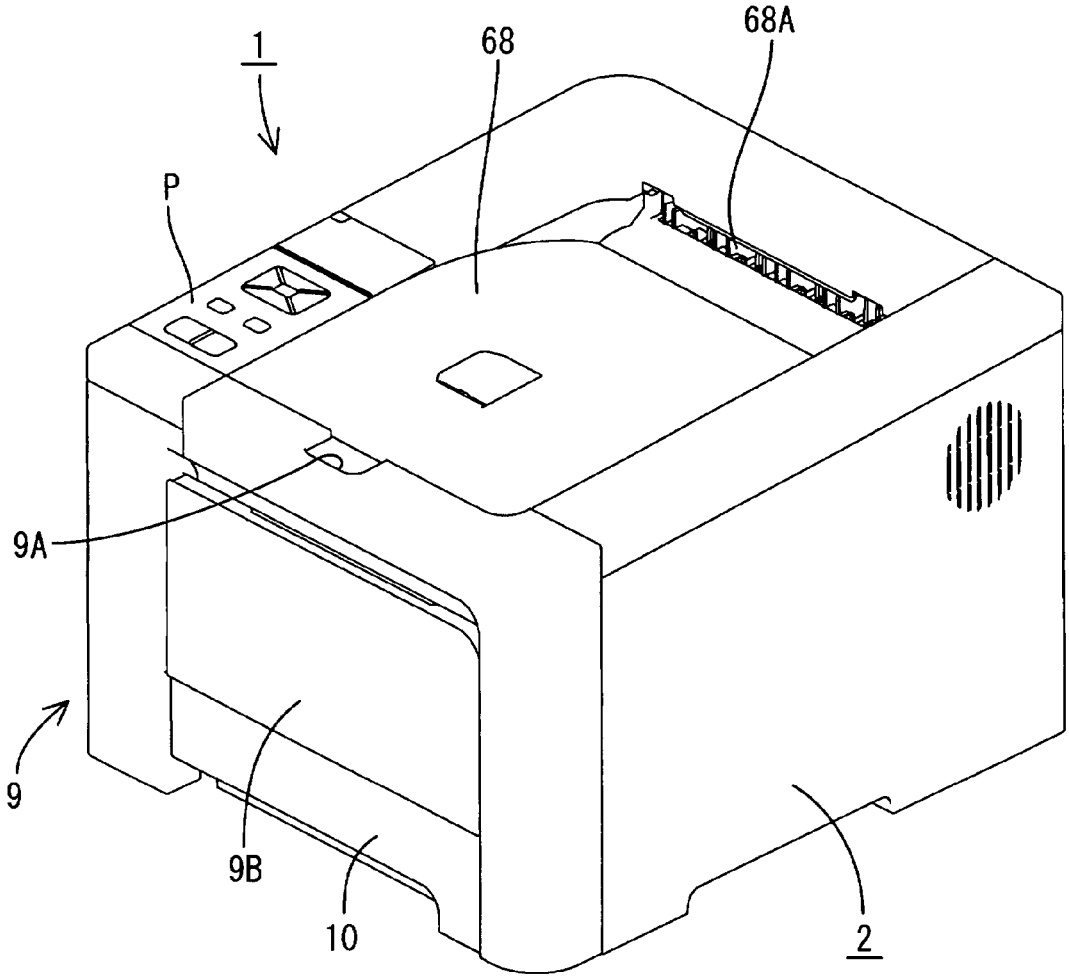
FIG. 1 is a perspective view showing an example of a laser printer according to an example structure 1 of the present invention.

FIG. 1 is a perspective view of a laser printer. The top wall of a main body casing 2 is formed in a recessed state so that the central portion in the width direction is slightly lowered toward the depth side, and is used as a paper discharge tray 68. A medium discharge opening 68A is provided in a portion serving as the back wall of the medium discharge tray 68. A medium 3 (such as paper sheet, plastic sheet, or the like; see FIG. 2) subjected to image formation is rendered to pass through the medium discharge opening 68A so as to be discharged from the deep side toward the front side of the apparatus. An operation panel P is provided on the top wall of the main body casing 2 at a lateral front end portion of the medium discharge tray 68.

Figure 2:
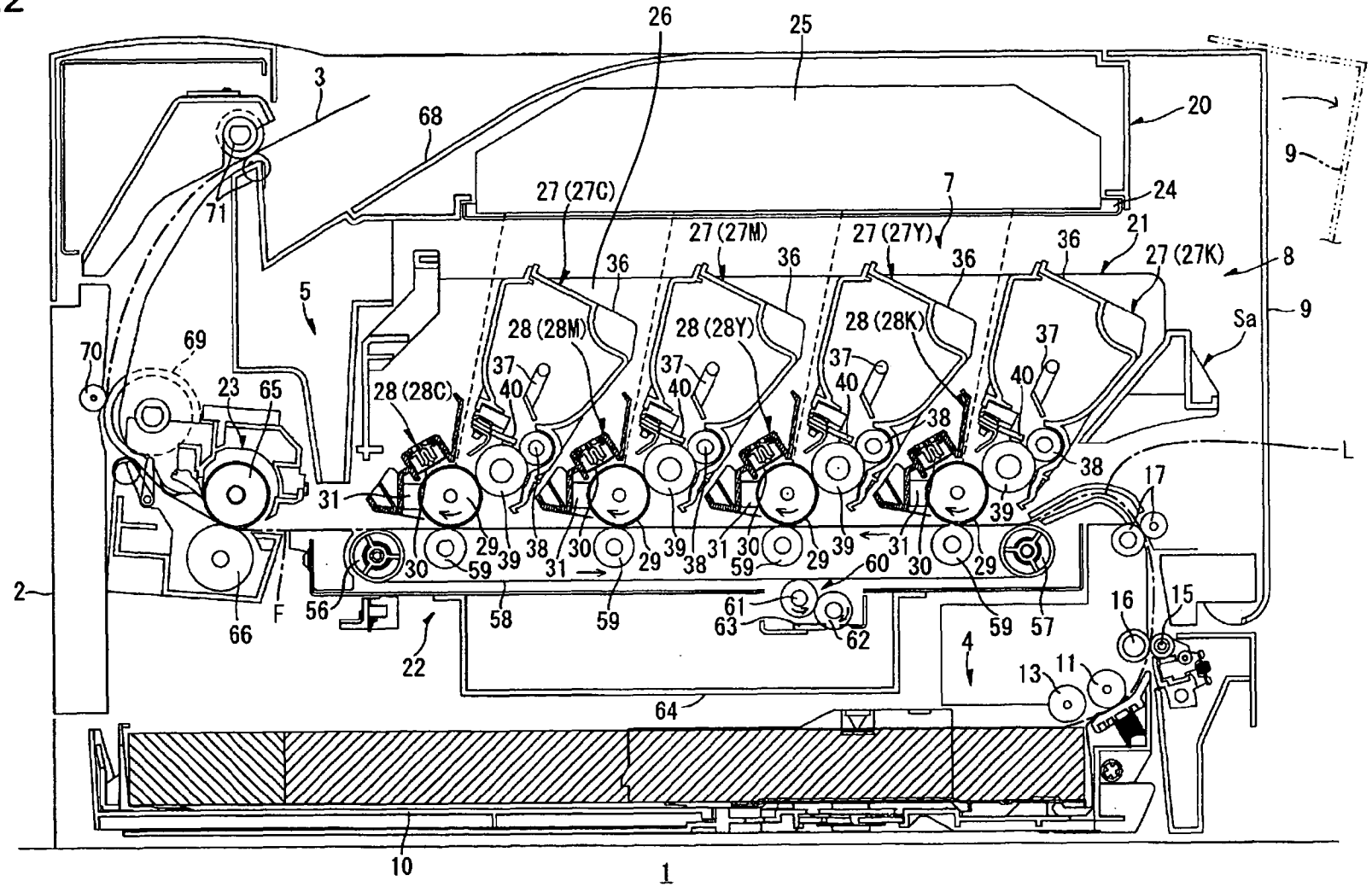
FIG. 2 is a sectional side view schematically showing a major portion of the laser printer in FIG. 1.
Figure 3:
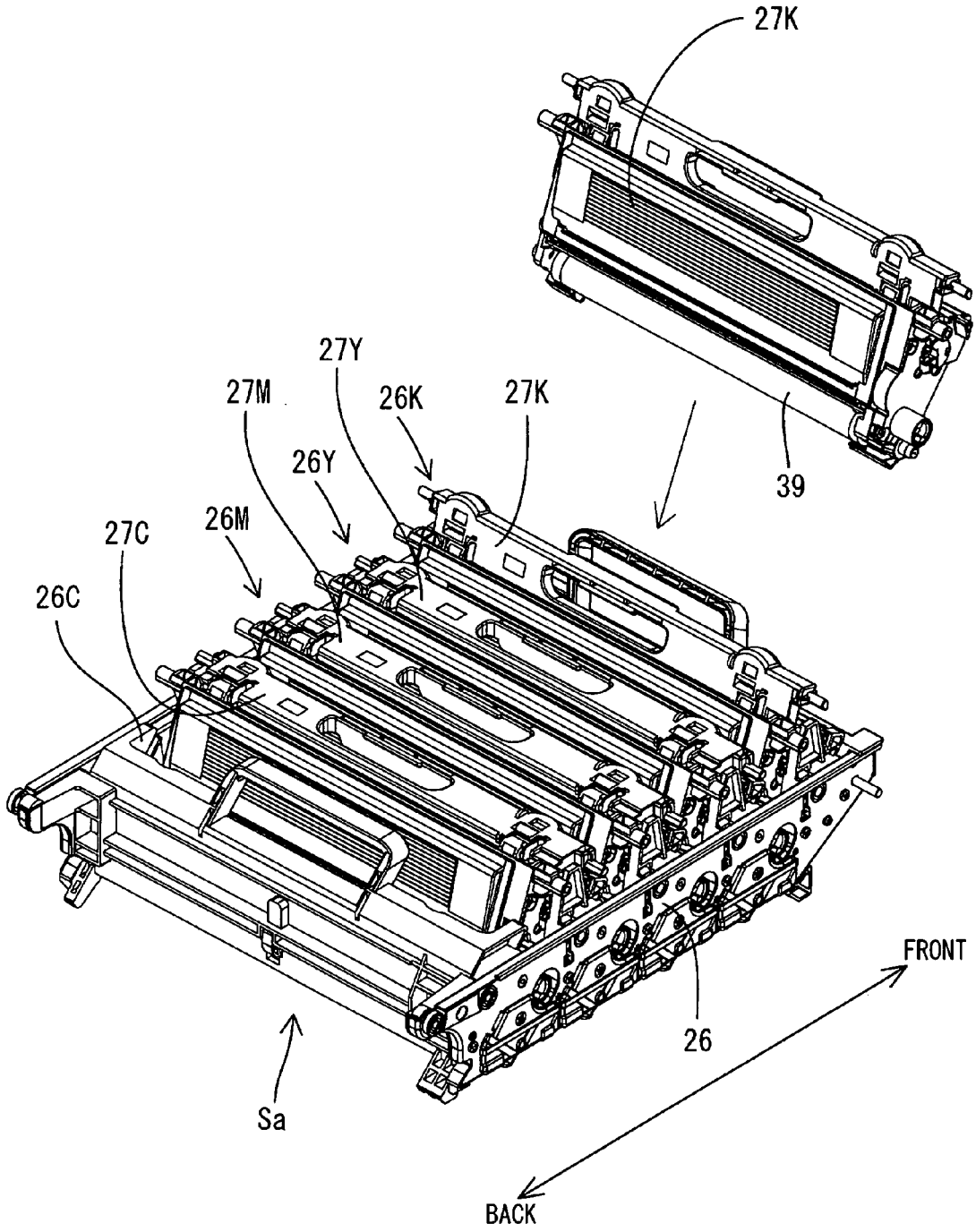
FIG. 3 is a perspective view of a drum unit.

Reference numeral 9 in FIG. 1 denotes a front cover (an example of an "opening and closing member conveyance path opening device"). The front cover 9 is provided for closing the opening of the front surface of the main body casing 2, and is connected by a hinged shaft (not shown) to the main body casing 2. The hinged shaft is provided in the lower part of the front surface of the main body casing 2, to which part the lower part of the front cover 9 is connected. The front cover 9 is rotated about the hinged shaft by the operation by placing a hand on an operating portion 9A provided in the upper part of the front cover 9. This makes it possible to close the opening of the front surface of the main body casing 2 by erecting the front cover 9 as shown in FIG. 1 (hereinafter referred to as a closed attitude), or to open the opening of the front surface of the main body casing 2 by tilting forward the front cover 9 as shown in FIG. 2 (hereinafter referred to as an opened attitude). Note that in the laser printer 1 according to the present example structure, the surface side on which the front cover 9 is formed is taken as the front side, and the surface side opposite to the front side is taken as the back side. Further, the directions perpendicular to the front and back directions and the up and down directions (namely, the height direction of the laser printer 1) are taken as the right and left directions of the laser printer 1.

Further, reference character 9B in FIG. 1 denotes are a manual feed tray. The manual feed tray 9B constitutes a part of the front cover 9, but is constituted by a component different from the panel constituting the front cover 9. The lower end portion of the manual feed tray 9B is connected to the panel so as to be rotatable with respect to the panel. When the upper end of the manual feed tray 9B is operated to the front side in FIG. 1, the panel of the front cover 9 is rotated so as to make only the manual feed tray 9B tilted forward with the opening portion closed. Thereby, the manual sheet insertion opening (not shown) is opened.

FIG. 2 is a sectional side view showing a major portion of the laser printer. In the following, respective devices constituting the laser printer will be briefly described with reference to FIG. 2.

The laser printer 1 (an example of "image forming apparatus") is, for example, a tandem-type color laser printer of horizontally laid type in which drum sub units 28K to 28C are arranged side by side in the right and left direction in FIG. 2, and which includes in the main body casing 2 a paper feed portion 4 for feeding a medium 3 (an example of "medium for recording") and an image forming portion 5 for forming an image on the fed medium 3.

A toner image is formed on the medium 3 fed out from the medium feed portion 4 in the process in which the medium is conveyed in a medium conveyance path L, and the toner image is heat-fixed by a fixing portion 23 so that a desired color image is formed.

The medium feed portion 4 can include a medium feed cassette 10, a separating roller 11, a medium feeding roller 13, and the like. Further, reference numeral 15, reference numeral 16 and reference numeral 17 denote a powder removing roller, a pinch roller and a resist roller, respectively.

Generally speaking, the image forming portion 5 is constituted by a scanner portion 20, a process portion 21, a transfer portion 22, a fixing portion 23, and the like.

The scanner portion 20 is arranged on the main body casing 2. This scanner portion 20 is provided with a supporting plate 24 that extends fore-and-aft directions and laterally, and a scanner unit 25 fixed to the top surface of this supporting plate 24. Within the scanner unit 25 are arranged, for example, optical members, such as four laser light sources, a polygon mirror, an fθlens, a reflecting mirror, and a plane inclination correcting lens. A laser beam based on image data emitted from each of the light sources is deflected by the polygon mirror, passes through the fθ lens and the plane inclination correcting lens, and is reflected by the reflection mirror. After that, the laser beam is applied to the surfaces of photosensitive drums 29 for each color, which will be described later, and an irradiation point on the photosensitive drum 29 is scanned at high speeds by the rotation of the polygon mirror.

The process portion 21 corresponding to image forming portion is provided with four drum subunits 28K to 28C and four development cartridges 27K to 27C, corresponding to colors of black, yellow, magenta, and cyan.

Each of the drum subunits 28K to 28C is constituted by the photosensitive drum 29 as an image carrying member, a charging device 30 (i.e. scorotron type charger), a cleaning brush 31, and the like.

In the lower part of a development frame 36 housing a toner, the development cartridges 27K to 27C are provided with a developing roller 39, a supply roller 38 and a layer thickness restricting blade 40. The developing roller 39 and the supply roller 38 are arranged opposite to each other, and have the function of supplying a toner from the supply roller 38 to the developing roller 39 during the passage of the toner between the two, and causing the toner to be frictionally charged with a positive polarity due to the friction caused by the rotation. The layer thickness restricting blade 40 is intended for making the layer thickness of the toner positively charged and uniformly carried on the developing roller 39.

The transfer portion 22 is provided with a driving roller 56, a driven roller 57 and a belt unit in which an sheet conveyance belt 58 corresponding to a conveying device is hung across four transfer rollers 59.

Each of the transfer rollers 59 is arranged opposite to each of the photosensitive drums 29. For example, the transfer rollers 59 are arranged at equal intervals as with the photosensitive drums 29, with the medium conveyance belt 58 interposed just under the photosensitive drums 29 that are arranged in the depth direction of the apparatus in an arrayed condition.

The medium conveyance belt 58 is made of a resin material, such as polycarbonate, and the width of the medium conveyance belt 58 is not less than the width of a printable maximum medium size (for example, A4 paper size). And when a driving force is transmitted to the driving roller 56 from a motor (not shown), the driving roller 56 begins to rotate. The medium conveyance belt 58 is driven in a circulating manner due to the rotation of this driving roller 56 and conveys mediums horizontally from the right-hand side to the left-hand side in FIG. 2.

The reference numeral 60 in FIG. 2 denotes a cleaning portion. The cleaning portion collects the remaining toner adhering to the medium conveyance belt 58 and cleans the conveyance surface of the medium conveyance belt 58, the reference numeral 61 denotes a primary cleaning roller, the reference numeral 62 denotes a secondary cleaning roller, the reference numeral 63 denotes a scraping blade, and the reference numeral 64 denotes a toner storing portion.

The fixing portion 23 is provided on the rear side of the transfer portion 22. The fixing portion 23 is constituted by a heating roller 65 and a pressure roller 66 that is installed opposite to the heating roller 65. The heating roller 65 is provided with a halogen lamp (not shown) for heating and the fixing portion 23 is intended for thermally fixing color toner images (developer images) transferred onto a medium by each of the transfer rollers 59 while the medium is passing through the heating roller 65 and the pressure roller 66.

After thermal fixing, the conveyance direction of the medium 3 is changed to an upward direction at the rear end of the apparatus and the medium 3 reaches the top surface wall of the main body casing. And the medium 3 is discharged by a medium discharge roller 71 onto the medium discharge tray 68. The reference numerals 69 and 70 denote, respectively, a conveyance roller and a pinch roller.

A brief description will be given here of a series of image forming processing steps by the laser printer 1 constructed as described above. First, the surface of each of the photosensitive drums 29 is positively charged in a uniform manner by the charging device 30 as the surface rotates. After that, when prescribed image data is input from a host device, for example, then control based on the image data is started and a laser beam is applied to each of the photosensitive drums 29 from each of the scanner portions 20. As a result of this, a prescribed electrostatic latent image corresponding to the image data is formed on the surface of each of the photosensitive drums 29, that is, the electric potential drops in the portion irradiated with the laser beam on the surface of the photosensitive drums 29 positively charged in a uniform manner.

Subsequently, the toner carried on the developing roller 39 and positively charged is supplied by the rotation of the developing roller 39 to the electrostatic latent image formed on the surface of each of the photosensitive drums 29. As a result of this, the electrostatic latent image of the photosensitive drums 29 is converted into a visible image and a toner image by reversal development is carried on the surface of the photosensitive drum 29.

In parallel with the processing for forming a toner image described above, the processing for conveying sheets is performed. That is, by the rotation of the feeding roller 13, mediums are delivered one by one from the supply cassette 10 to the medium conveyance path L. The medium delivered to the medium conveyance path L is carried by the pinch roller 16 and the medium conveyance belt 58 to the transfer position (the point at which each of the photosensitive rollers comes into contact with each of the transfer rollers). Then, during the passing of the medium through this transfer point, toner images (developer images) of each color carried on the surface of each of the photosensitive drums 29 are transferred in a superimposed manner to the surface of the medium by a transfer bias applied to each of the transfer rollers 59. In this manner, color toner images (developer images) are formed on the medium. After that, during the passage through the fixing portion 23 which is described next, the transferred toner images (developer images) are thermally fixed and the medium is discharged on the medium discharge tray 68.

2. Drum Unit and Depressing and Spacing Device

An opening portion on the front surface of the main body casing 2 is used as an attaching/detaching opening 8 communicating with a drum containing space 7 in the main body casing 2, through which opening a drum unit Sa can be contained in the drum containing space 7 in the main body casing 2. Further, the laser printer 1 according to the present example structure incorporates a depressing and spacing device Sb which makes developing rollers 39 operate and will be described below. In the following, the drum unit Sa and the depressing and spacing device Sb will be specifically described.

(A) Drum Unit

The drum unit Sa includes a unit frame 26 with cartridge containing portions 26K to 26C in the front and back direction of the laser printer 1 (hereinafter also referred to as "apparatus"). Developing cartridges 27K to 27C of respective colors can be contained in or extracted from the cartridge containing portions by an operation from above.

Figure 4:
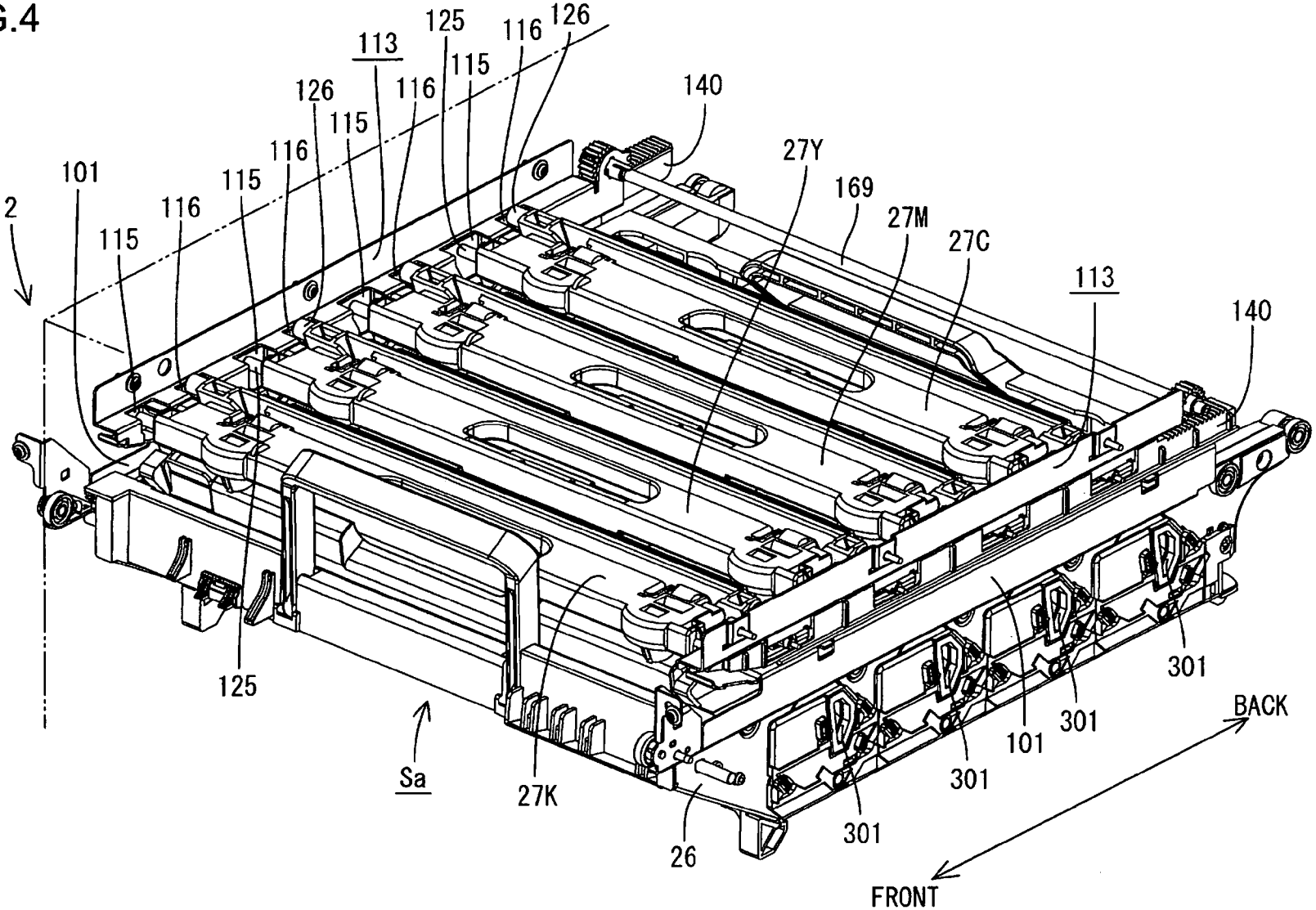
FIG. 4 is a perspective view showing a positional relation between a depressing and spacing device, and the drum unit.

The above described drum unit Sa can be contained, as shown in FIG. 4, in the drum containing space 7 of the main body casing 2 in a state where the horizontal attitude of the drum unit is maintained by the guiding action of a pair of rails 101 provided on the inner surface wall of the main body casing 2.

(B) Depressing and Spacing Device Sb

When the drum unit Sa is contained in the drum containing space 7 of the main body casing 2, the depressing and spacing device Sb presses down the developing cartridge 27 so as to bring the developing roller 39 into contact with a photosensitive drum 29, which facilitates image formation. Further, the depressing and spacing device Sb releases the pressing down of the developing cartridge 27.

Figure 5:
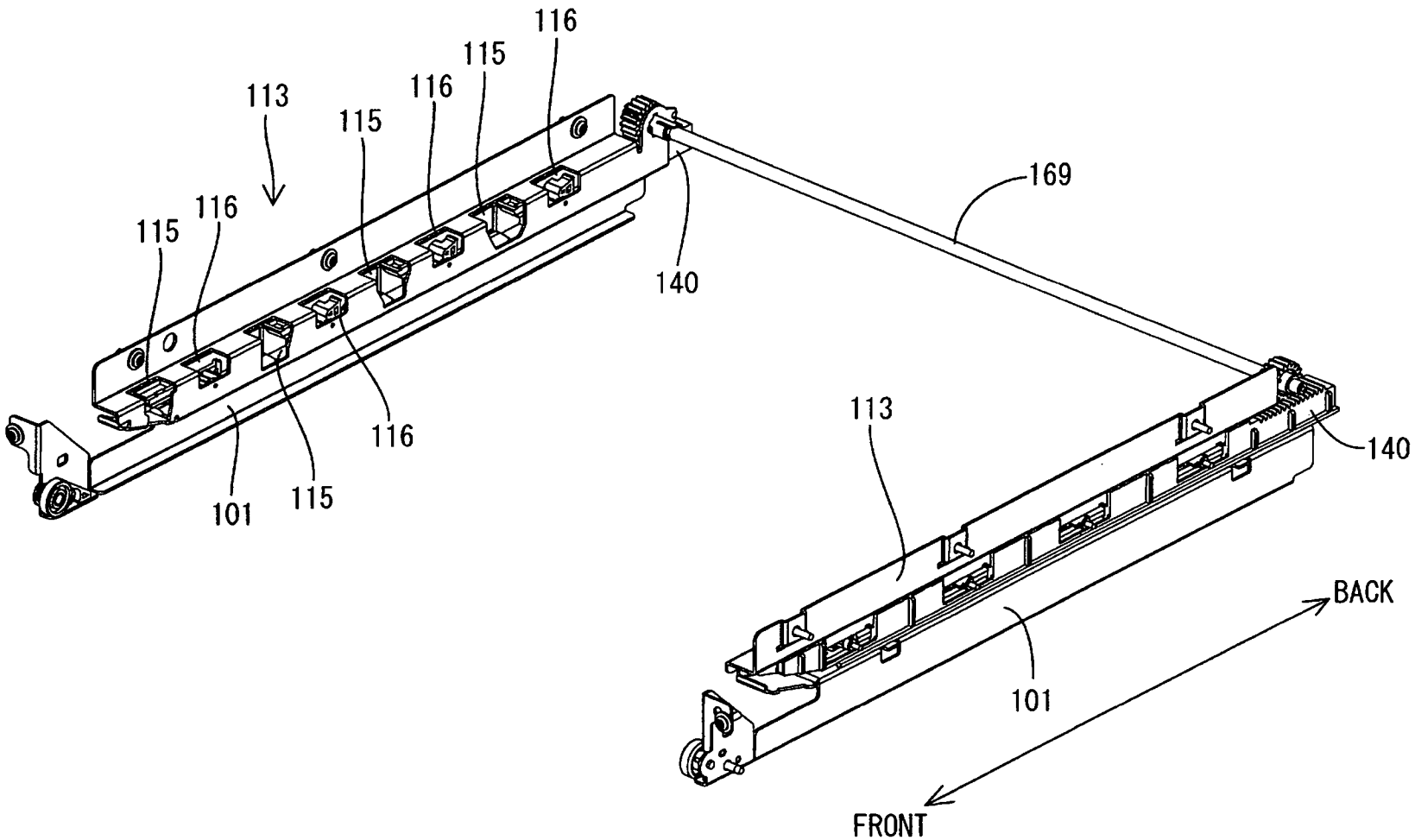
FIG. 5 is a perspective view of the depressing and spacing device.
Figure 6:
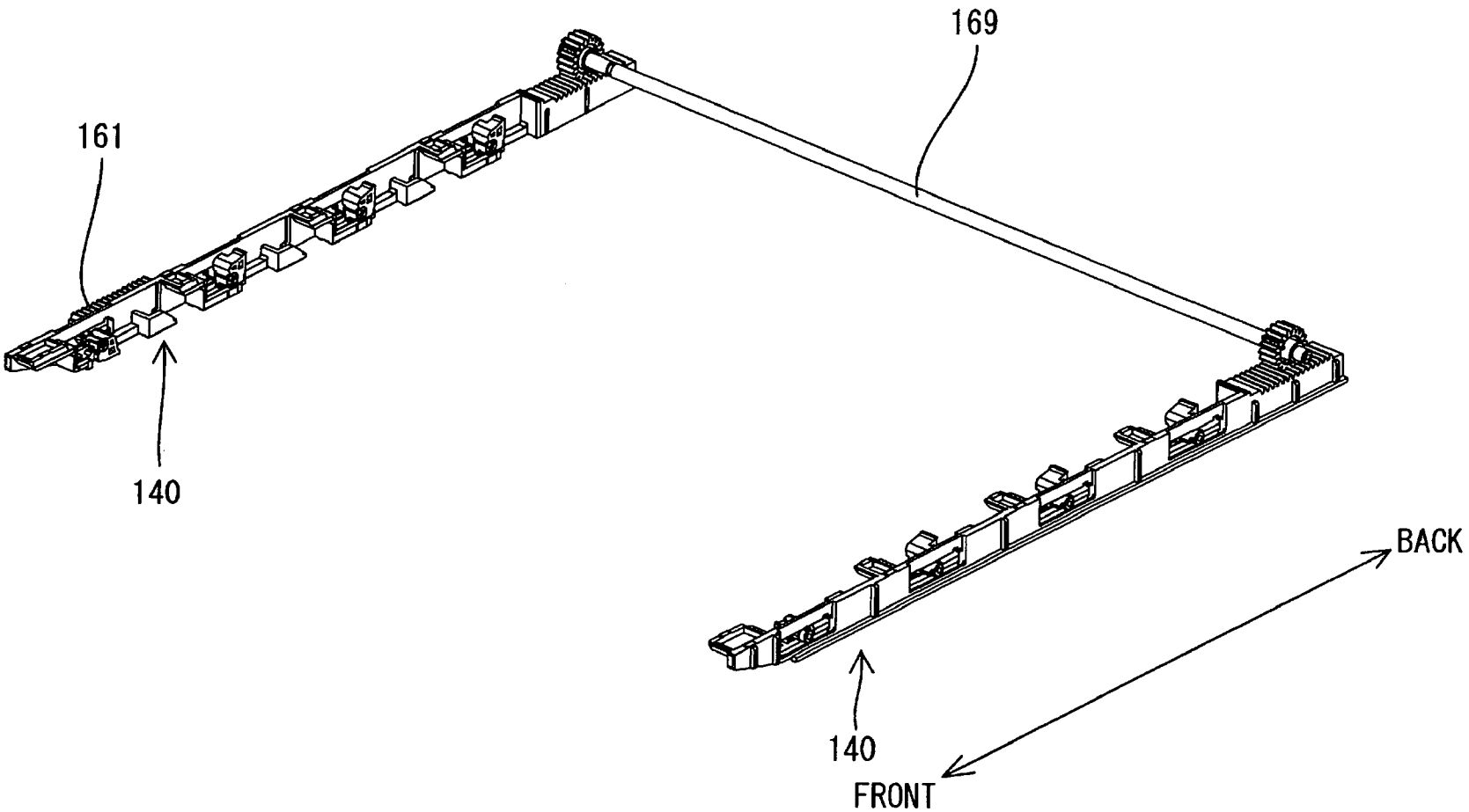
FIG. 6 is a perspective view of a direct acting cam member.
Figure 7:
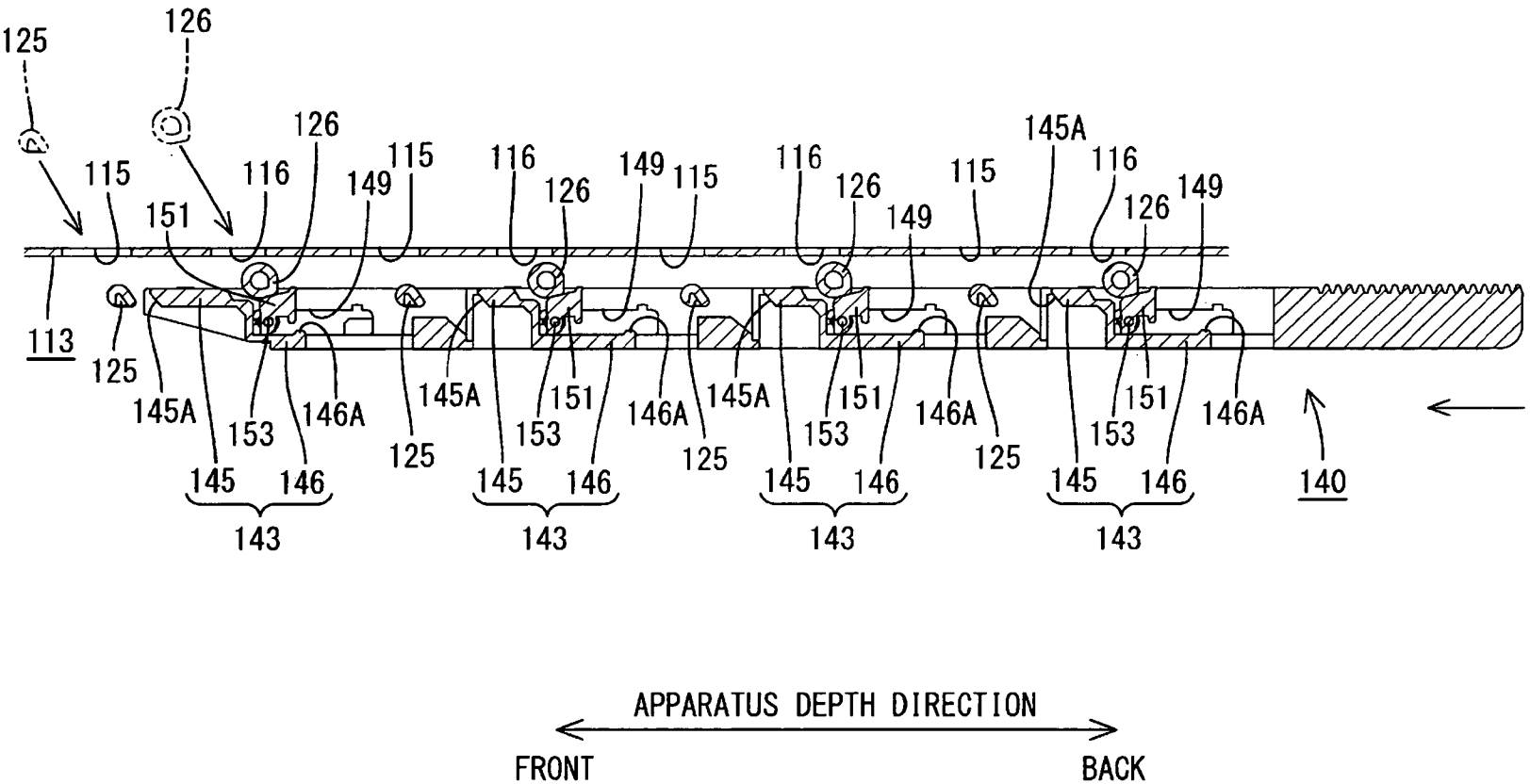
FIG. 7 is a figure showing a release position of the direct acting cam member.
Figure 8:
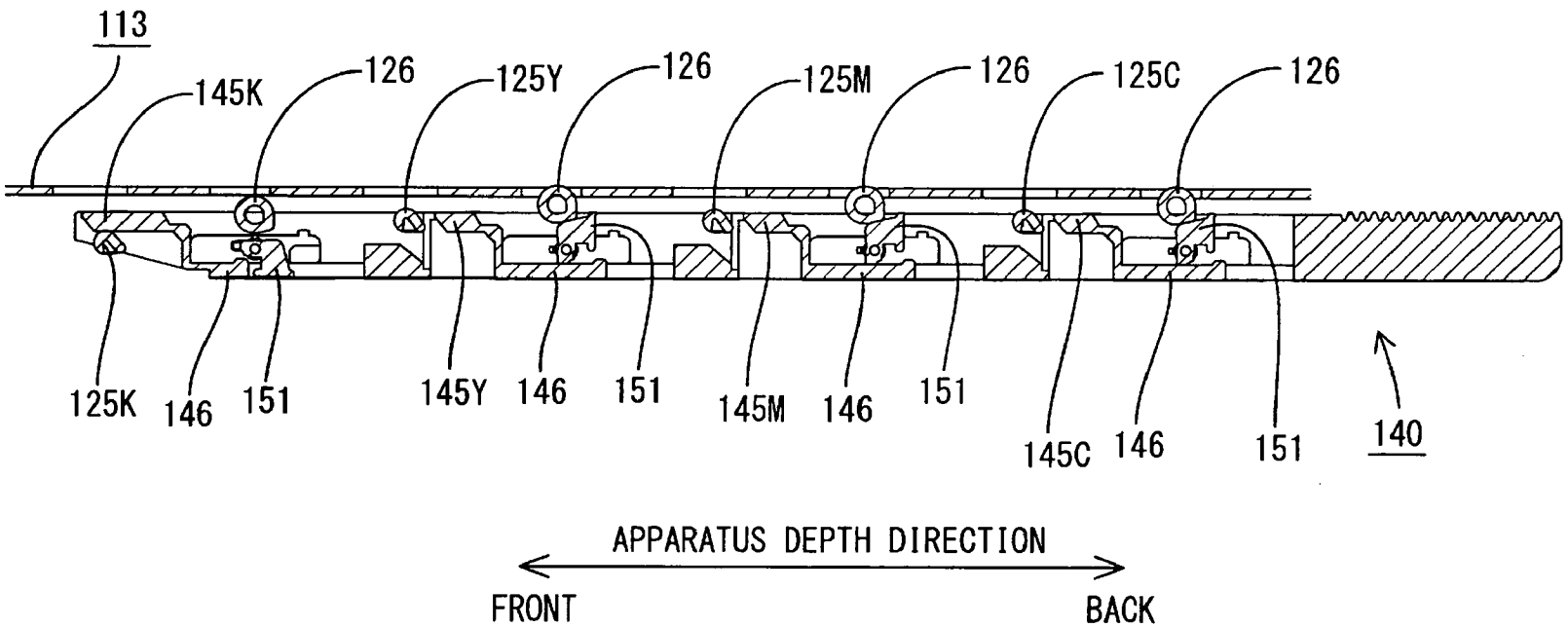
FIG. 8 is a figure showing an intermediate position of the direct acting cam member.
Figure 9:
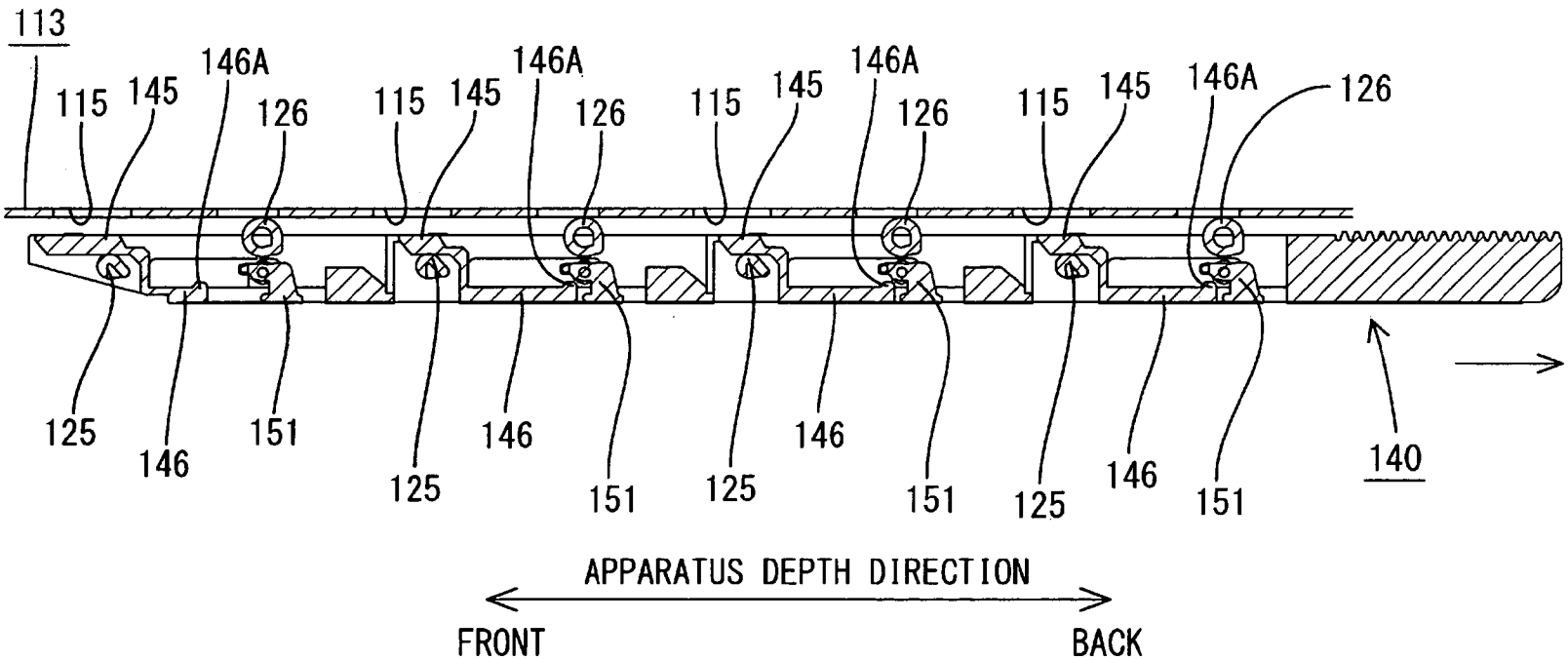
FIG. 9 is a figure showing a depressing position of the direct acting cam member.
Figure 10:
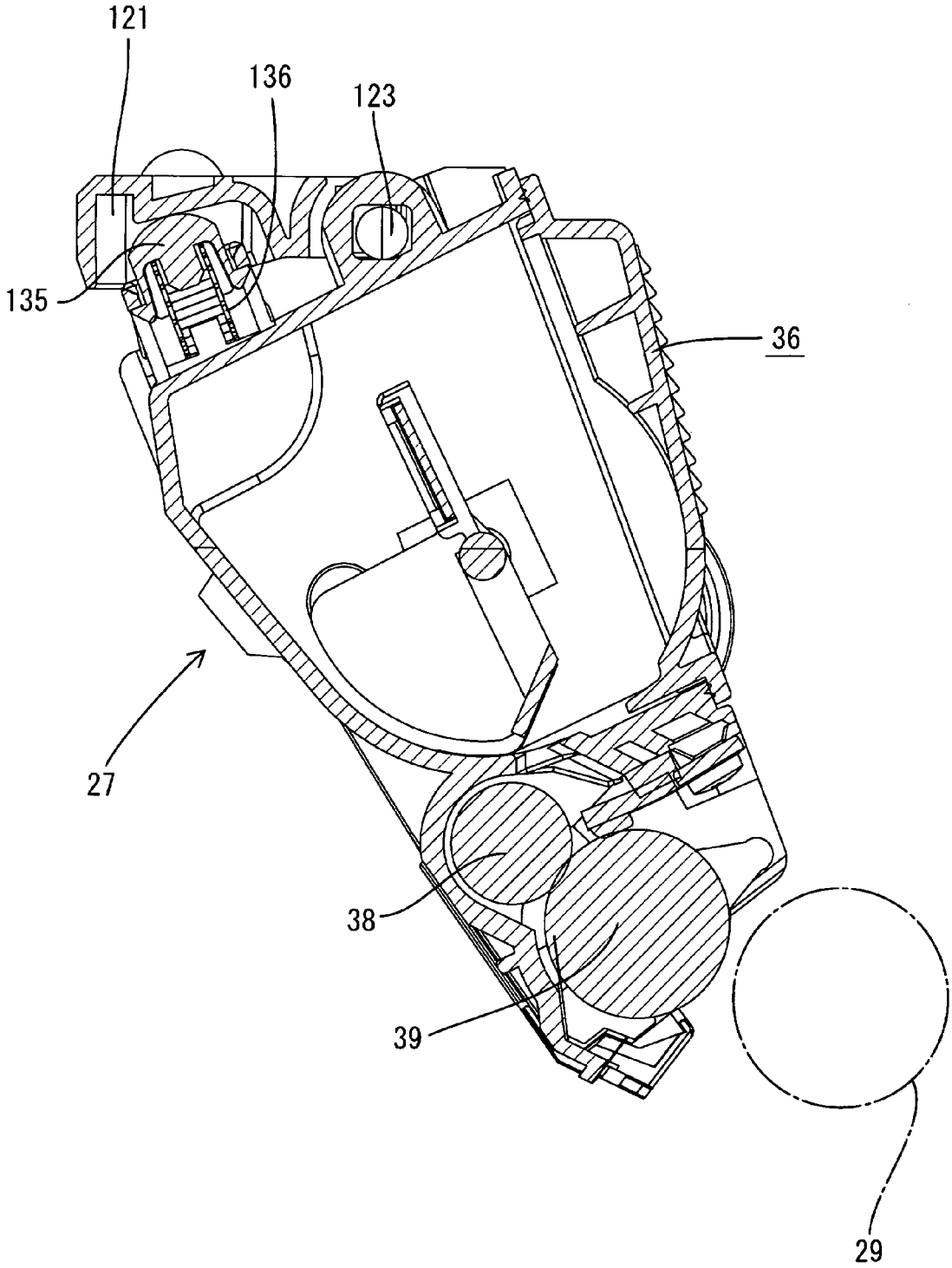
FIG. 10 is a vertical sectional view of a developing cartridge.
Figure 11:
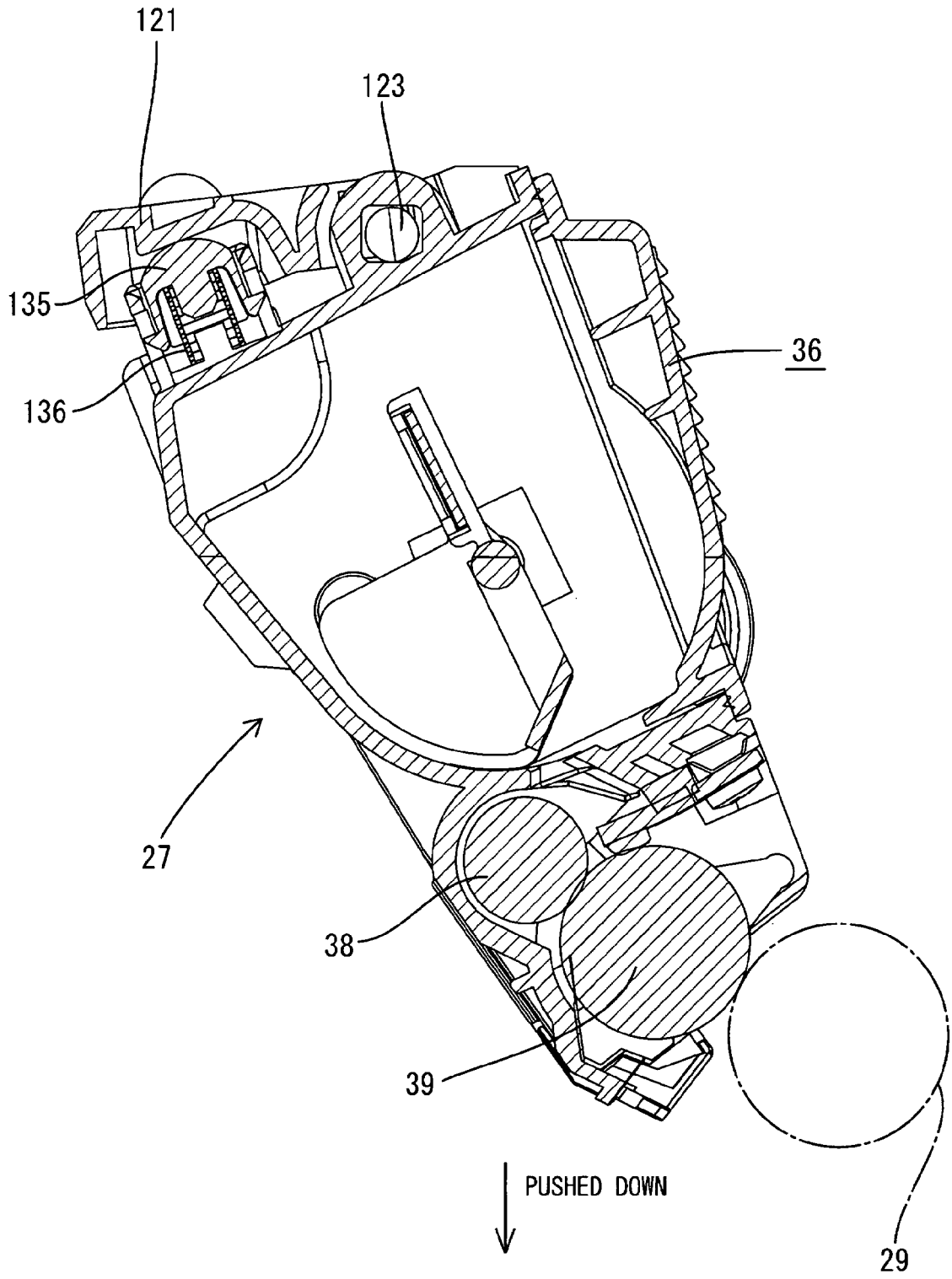
FIG. 11 is a similar vertical sectional view of the developing cartridge (showing a state of being depressed to the lower part of the apparatus)

FIG. 4 is a perspective view showing a positional relation between the depressing and spacing device Sb and the drum unit Sa, and FIG. 5 is a perspective view showing the depressing and spacing device Sb. FIG. 6 is a perspective view showing a direct acting cam member, and FIG. 7 is a figure showing a release position of the direct acting cam member. Further, FIG. 8 is a figure showing an intermediate position of the direct acting cam member, and FIG. 9 is a figure showing a depressing position of the direct acting cam member. Further, FIG. 10 is a vertical sectional view showing the developing cartridge. Similarly, FIG. 11 is a vertical sectional view showing the developing cartridge, and showing in detail the state where the developing cartridge is pressed downward.

As shown in FIG. 6, on each of the two right and left side walls of the main body casing 2, there is provided a direct-acting cam member 140 having an elongated shape in the fore-and-aft directions, with the longitudinal direction thereof directed to the depth direction of the apparatus. On the inner surface of each of the two side walls of the main body casing 2, there is provided a cam holder 113, and the direct-acting cam member 140 is inserted into the cam holder 113 in a condition permitting forward and backward motions. The installation height of the direct-acting cam member 140 is a height corresponding to the upper portion of the drum unit Sa housed in the drum housing space 7, i.e., the upper portion of each of the development cartridges 27.

The reference numeral 169 shown in FIG. 6 to FIG. 8 denotes a connecting shaft. The connecting shaft 169 connects tail ends of the two direct-acting cam members 140 and has the function of causing a driving force to be transmitted. Concretely, the direct-acting cam member 140 in the left-hand back side in FIG. 8 is the main side, and the direct-acting cam member 140 on the right-hand front side is the sub-side.

The direct-acting cam member 140 on the main side moves forward and backward, the forward and backward motions on the main side are transmitted to the direct-acting cam member 140 on the sub-side via the connecting shaft 169, and the direct-acting cam member 140 on the sub-side moves forward and backward in synchronization with the direct-acting cam member 140 on the main side. Though, in the transmission of the driving force by the connecting shaft 169, as shown in FIG. 6, the power is transmitted by using the gear engagement by a rack gear 141 and a pinion gear 142.

Further, the depressing and spacing device Sb is constituted in such a manner that as shown in FIG. 4, by the advancing/retracting operation of a direct acting cam member 140, depressing protrusions 125 provided on both the right and left sides of each developing cartridge 27 are pushed downward, or spacing protrusions 126 provided on both the right and left sides of each developing cartridge 27 are pushed upward.

Corresponding to the above-described protrusions 125, 126, as shown in FIG. 7, on the top surface of the cam holder 113 of the depressing and spacing device Sb, four sets of a first communication hole 115 and a second communication hole 116 are longitudinally provided by being spaced from each other.

Next, the shape of the direct-acting cam member 140 will be described by taking the direct-acting cam member 140 on the main side as an example. As shown in FIG. 7, the direct-acting cam member 140 has a shape elongated in one direction and is provided with four working portions 143 in the longitudinal direction. Each of the working portions 143 is provided at prescribed intervals (for example, the intervals correspond to the arrangement intervals of the development cartridges 27K to 27C), and is constituted by a working portion for depression 145 and a working portion for connection/separation 146.

The working portion for depression 145 has a shape that is horizontally elongated in the left-hand direction in FIG. 7 and a taper 145A is formed at the leading end thereof. The taper 145A is formed to have a shape obtained by cutting off the lower part of the leading end of the working portion for depression 145 on the slant.

On the other hand, the working portion for connection/separation 146 has a shape that is horizontally elongated in the right-hand direction in the figure, and a protrusion 146A that overhangs upward as shown in the figure. The working portion for connection/separation 146 is intended for rotating a rotary pushup member 151 in synchronization with the forward and backward motions of the direct-acting cam member 140.

The rotary pushup member 151 is rotatably supported by a supporting shaft 153 fixed to the main body casing 2. On the other hand, an escape hole 149 through which the supporting shaft 153 is inserted is opened in the direct-acting cam member 140, and the direct-acting cam member 140 can move independently of the fixed rotary pushup member 151.

As a result of this, rotary pushup member 151 performs only a rotary motion in situ (in a fixed position) without performing a sliding motion as one piece in association with the forward and backward motions of the direct-acting cam member 140.

The rotary pushup member 151 corresponds to the spacing protrusion 126 of each of the development cartridges 27 and the installation position of all of the rotary pushup members 151 is in the vicinity just under the second communication hole 116. This direct-acting cam member 140 can perform reciprocating straight-line motions between the disengaging position shown in FIG. 7 and the depressing position shown in FIG. 9.

With the direct-acting cam member 140 present in a disengaging position, behind the first communication hole 115 (the right-hand side in FIG. 7) the working portion for depression 145 opens the first communication hole 115.

For this reason, as shown in FIG. 2, when the drum unit Sa has been housed in the drum housing space 7, each of the depressing protrusions 125 enters the interior of the cam holder 113 through the correspondarring first communication hole 115, and as shown in FIG. 7 the depressing protrusion 125 and the working portion for depression 145 come into a face-to-face condition, spaced from each other at a prescribed distance in the horizontal direction.

The spacing protrusion 126 enters the interior of the cam holder 113 through the second communication hole 116 and abuts against the top of the rear surface of the rotary pushup member 151.

When the direct-acting cam member 140 is moved from this condition toward a depressing position in the left-hand direction indicated in the figure (the front side of the main body of the apparatus), during this process of movement the working portion for depression 145 abuts against the depressing protrusion 125.

After that, by the guiding action of the taper 145A, the working portion for depression 145 moves onto the depressing protrusion 125 while pushing down the depressing protrusion 125, and when the direct-acting cam member 140 has reached the depressing position shown in FIG. 9, the depressing protrusion 125 is already under the working portion for depression 145.

As described above, in the process of the movement of the direct-acting cam member 140 from a disengaging position to a depressing position, the working portion for depression 145 pushes down the depressing protrusion 125, and eventually the handle 121 shown in FIG. 10. For this reason, the whole development cartridge 27 is pushed downward, with the coil spring 136 shrunk, and as a result that the developing roller 39 of the development cartridge 27 comes into elastic contact with the photosensitive drum 29 (see FIG. 11).

As shown in FIG. 9, when the direct-acting cam member 140 has reached a depressing position, the working portion for depression 145 stops up the first communication hole 115 and the depressing protrusion 125 comes into a latched condition. For this reason, in order to remove the development cartridge 27 and eventually the drum unit Sa from the drum housing space 7 of the main body casing 2, it is necessary to move the direct-acting cam member 140 again from a depressing position to a disengaging position.

In this illustrative aspect, the four depressing protrusions 125 are provided so as to correspond to the development cartridges 27K to 27C. However, the depressing protrusion 125K corresponding to the "black" development cartridge 27K, for example, is pressed to the working portion for depression 145K at a timing earlier than the remaining depressing protrusions 125Y to 125C (in an intermediate position from a disengaging position to a depressing position) (see FIG. 8).

This may be the result of black-and-white printing, so that only that the developing roller 39 corresponding to the color black be brought into contact with the photosensitive drum 29 corresponding to this developing roller 39 and because it is unnecessary to bring this developing roller 39 into contact with the photosensitive drums 29 of other colors.

Next, the spacing action will be described. When the direct-acting cam member 140 is caused to slide from the depressing position shown in FIG. 9 to the disengaging position shown in FIG. 7, the engagement between the depressing protrusion 125 and the working portion for depression 145 becomes undone. On the other hand, the protrusion 146A of the working portion for connection/separation 146 abuts against the rotary pushup member 151, thereby rotating the rotary pushup member 151 counterclockwise.

Because of this, the rear surface of the rotary pushup member 151 abuts against the lower surface of the spacing protrusion 126 and pushes up the spacing protrusion 126. As a result of this, an upward force acts on each of the development cartridges 27K to 27C via each of the spacing protrusions 126 and thus each of the development cartridges 27 is capable of floating a little from the unit frame 26. That is, the developing rollers 39 is brought from a position being contact with the photosensitive drums 29 shown in FIG. 11 into a position being distant from the photosensitive drums 29 shown in FIG. 10.

When the drum unit Sa is later taken out of the drum housing space 7, performing a spacing action as described above enables each of the development cartridges 27K to 27C to be easily taken out of the taken-out drum unit Sa.

Figure 12:
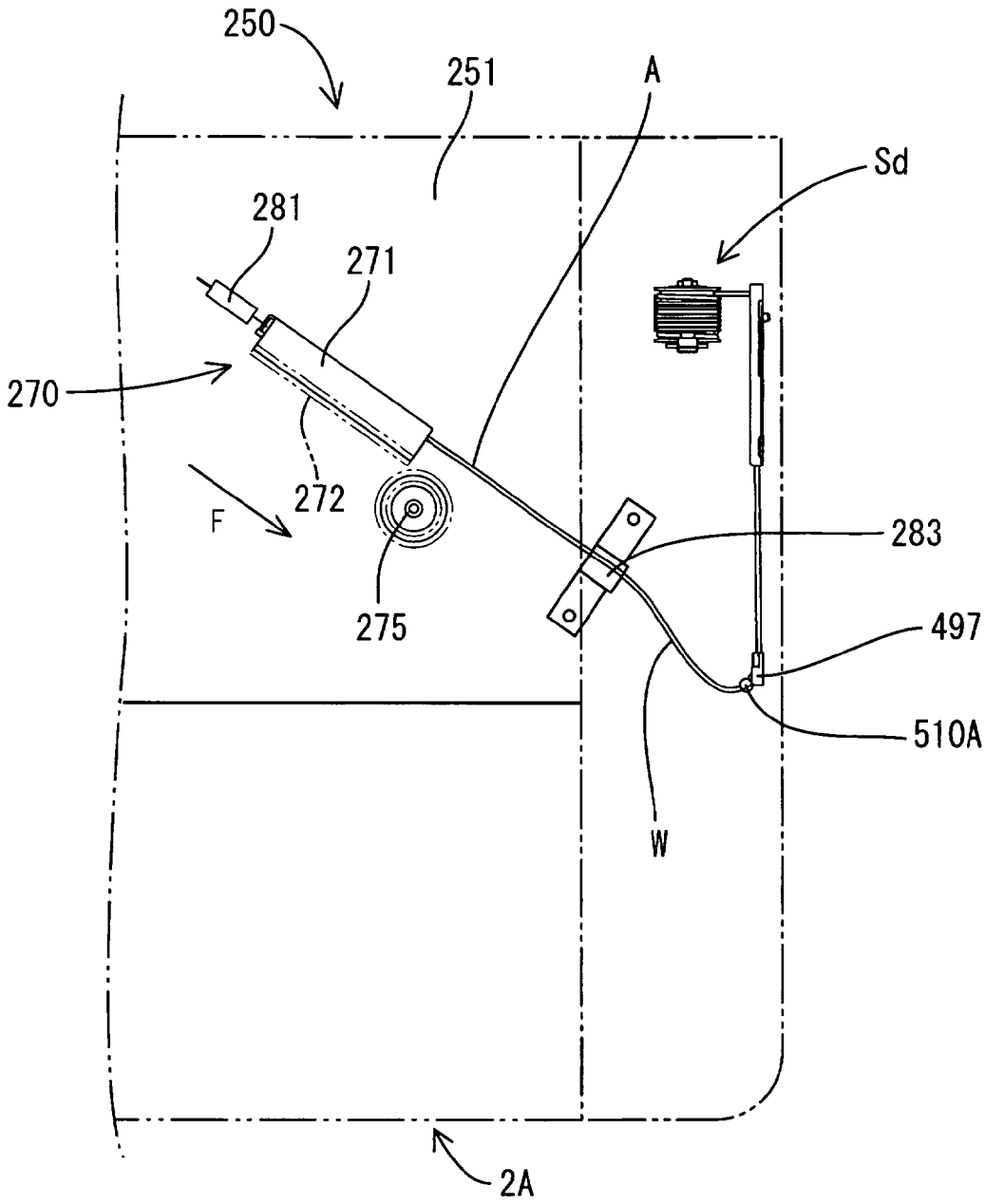
FIG. 12 is a figure showing an initial position of a synchronous slider.
Figure 13:
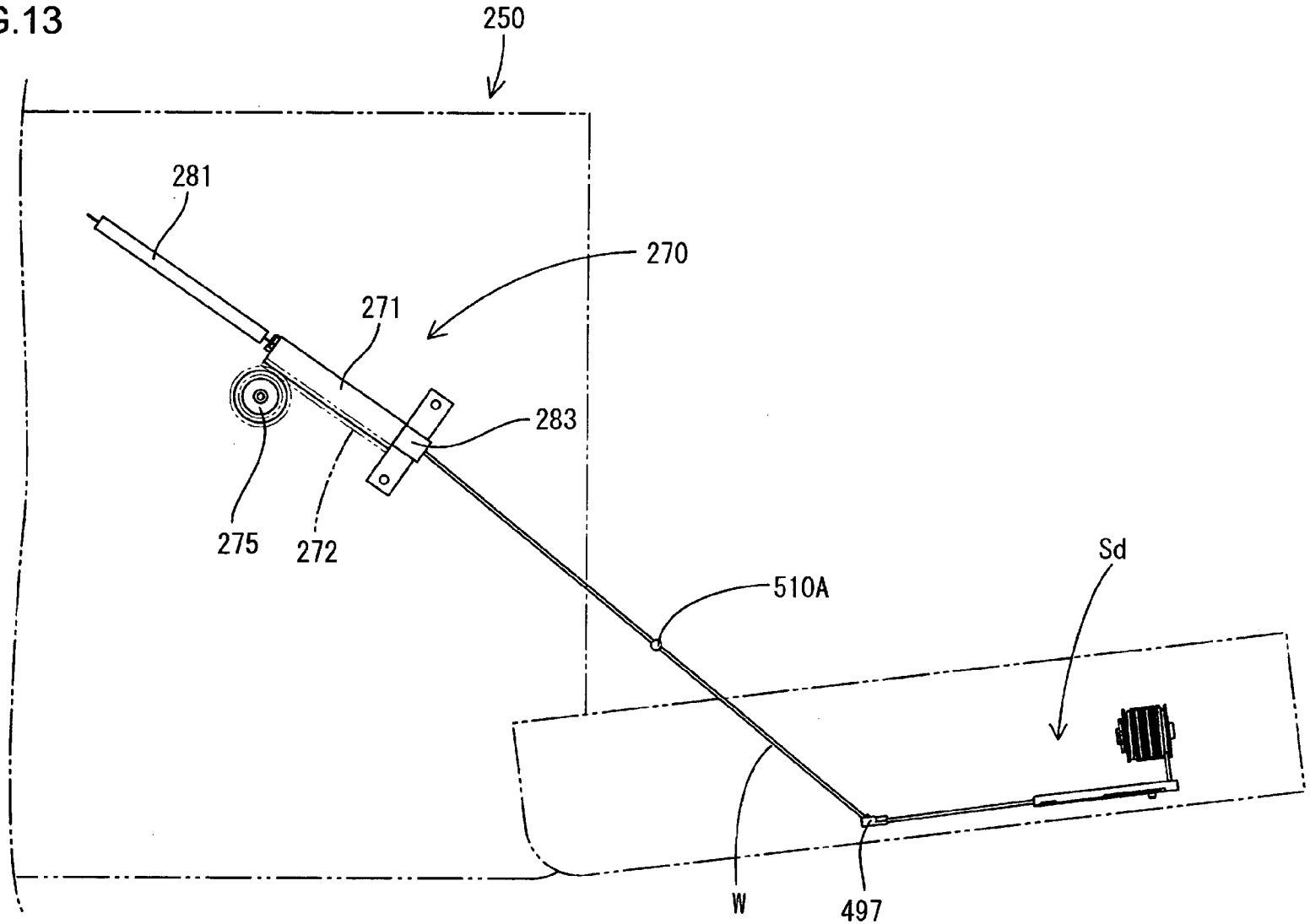
FIG. 13 is a figure showing a stop position of the synchronous slider.
Figure 14:
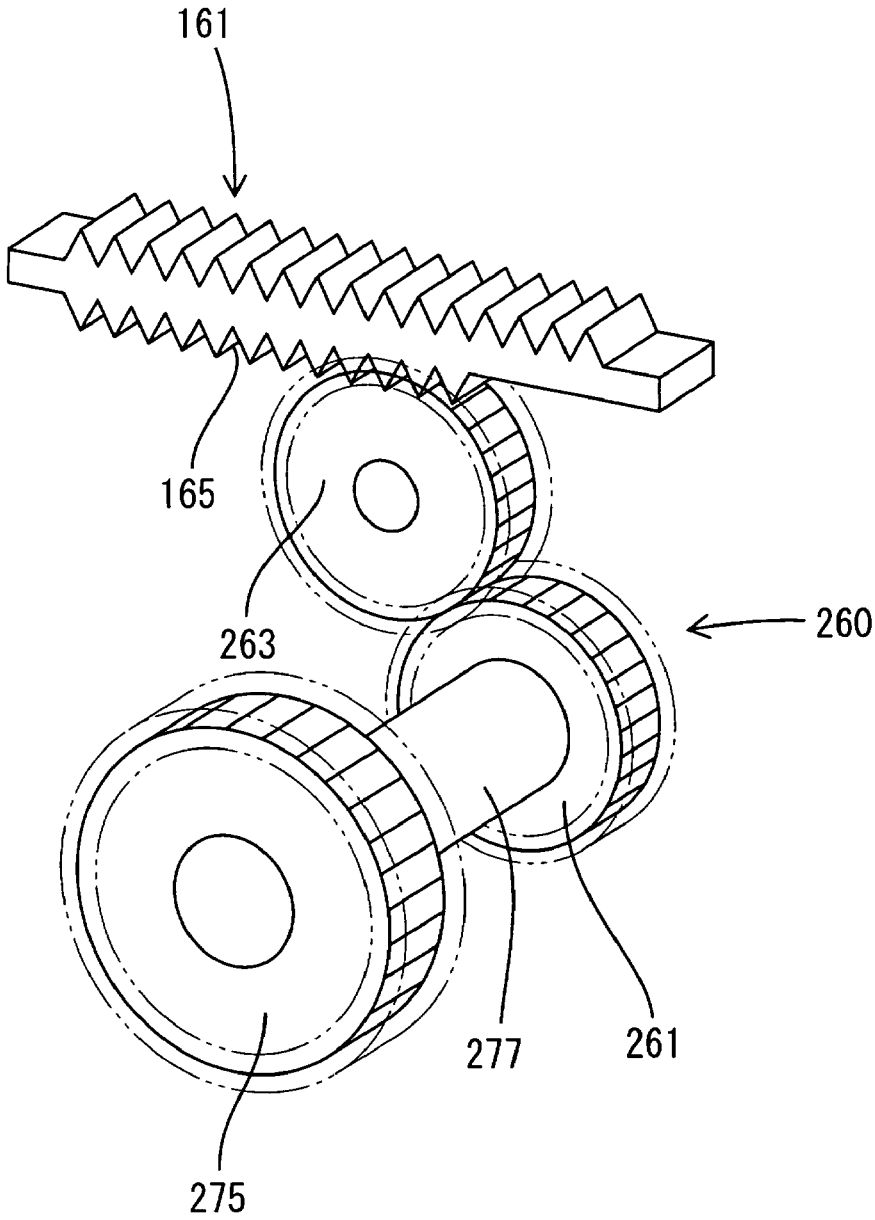
FIG. 14 is a figure showing that a pinion gear is connected to a constant-position gear by a shaft.

Linearly reciprocating the above described direct acting cam member 140 between the release position and the depressing position can be accomplished using a driving source. In the present example structure, there is provided a drive system 250 which utilizes the opening and closing movement of the front cover 9 and is constituted by a gear device 260 and a linking device 270 which drives the gear device 260 by being linked with the opening operation of the front cover 9 (see FIG. 12, FIG. 13 and FIG. 14). Note that FIG. 12 is a figure showing an initial position of a synchronous slider 271, and FIG. 13 is a figure showing a stop position of the synchronous slider 271. Further, FIG. 14 is a figure showing that a constant-position gear 261 is connected with a pinion gear 275 by a shaft 277.

As shown in FIG. 12, an upper part of the outer surface of the left side wall 2A of the main body casing 2 is used as an installation portion 251. The linking device 270 is installed in the installation portion 251. The linking device 270 is constituted by the synchronous slider 271 and the pinion gear 275 forming a pair with the synchronous slider 271.

As shown in FIG. 12, the synchronous slider 271 has a long shape in one direction and is provided with a toothed portion 272 in its lower part. Further, a coil spring 281 for energization is provided in the rear part of the synchronous slider 271, so as to pull the synchronous slider 271 to an initial position as shown in FIG. 13. Further, the pinion gear 275 is installed a predetermined distance from the synchronous slider 271, in the front lower part of the synchronous slider 271.

One end A of a wire W is fixed to the front end of the synchronous slider 271. The synchronous slider 271 is pulled to the front of the apparatus via the wire W in linkage with the opening operation of the front cover 9. Thereby, the synchronous slider 271 moves to the direction of the arrow F shown in FIG. 12, while expanding the coil spring 281. Then, in the process of the movement, the toothed portion 272 of the synchronous slider 271 meshed with the toothed portion of the pinion gear 275 so as to rotate the pinion gear 275.

As shown in FIG. 14, the shaft 277 of the gear device 260 connects the pinion gear 275 and the constant-position gear 261. For this reason, when the pinion gear 275 rotates, the constant-position gear 261 rotates as one piece with the pinion gear 275.

A slider stopper 283 is provided on the front side of the synchronous slider 271 in the travel direction. When the slider 271 has reached the stop position shown in FIG. 13 after the movement over a predetermined stroke, the front end of the synchronous slider 271 abuts against the slider stopper 283 and a further forward motion is restricted.

The gear device 260 is constituted by including a pair of the constant-position gear 261 and a swivel gear 263 which are in mesh with each other. When the synchronous slider 271 slides from the initial position toward the stop position to rotate the pinion gear 275 in response to the opening of the front cover 9, the constant-position gear 261 turns (rotates), and the gear 263 is in mesh with a gear 165 of a power input plate 161 (see FIG. 6) so as to enable the power to be transmitted.

When the front cover 9 is brought down to make the synchronous slider 271 pulled toward the stop position, the swivel gear 263 is rotated while being engaged with the gear 165. This makes the power input plate 161 horizontally move with the direct acting cam member 140 in the disengaging direction to reach the disengaging position, so that the developing roller 39 is separated from the photosensitive drum 29.

3. Electrical Constitution

Figure 15:
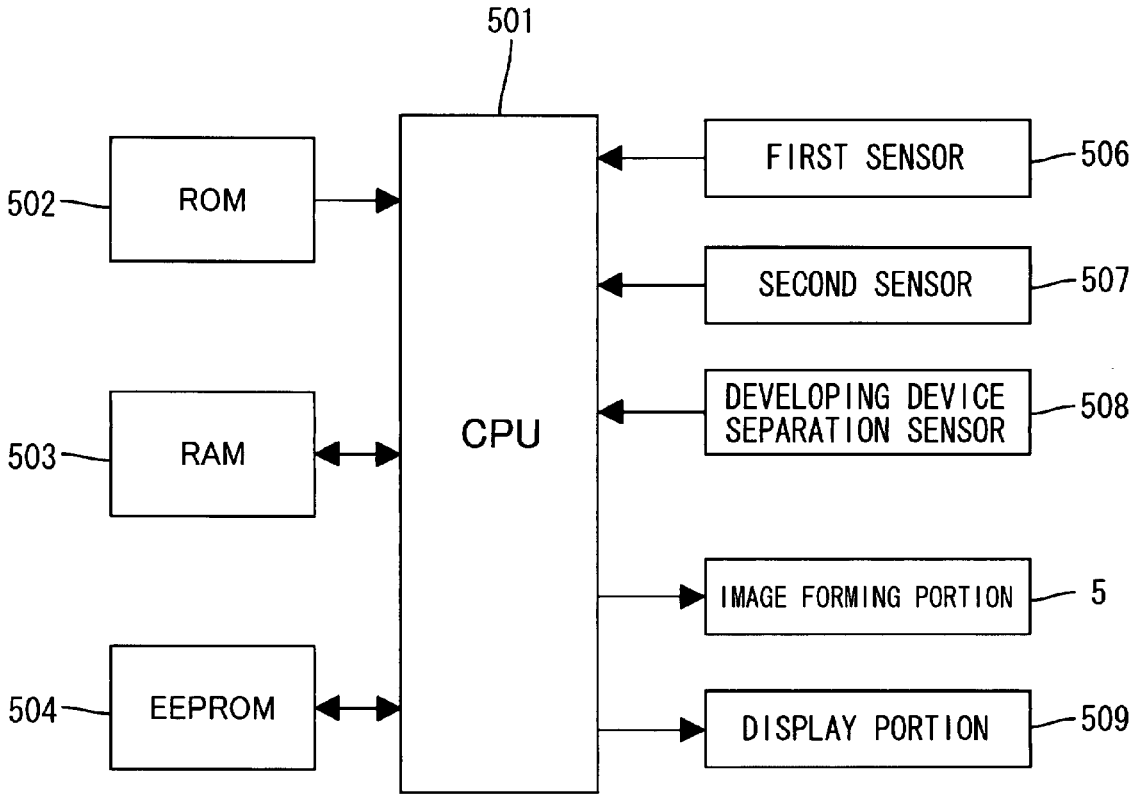
FIG. 15 is a block diagram showing an electrical constitution of the laser printer in FIG. 1.

Next, the electrical constitution of the laser printer 1 is described. FIG. 15 is a block diagram showing an example of an electrical constitution of the laser printer 1.

The laser printer 1 includes a CPU 501, a ROM 502, a RAM 503 and an EEPROM 504 (an example of "nonvolatile storage device") as shown in FIG. 15. The CPU 501 is connected with a first sensor 506, a second sensor 507, a developing device separation sensor 508, an image forming portion 5 (i.e. various electrical components of the image forming portion 5), and a display portion 509 consisting of various lamps, a liquid crystal panel and the like. Note that a bus line and various circuits (A/D conversion circuit and the like) are omitted for sake of simplicity. In addition to these, an operating portion such as an input panel (not shown) and a network interface for the connection with an external device or the like are provided so as to constitute an electrical system. Note that the CPU 501 corresponds to respective examples of an operation inhibiting device, a medium removal processing detecting device, and an information erasing device.

Figure 16:
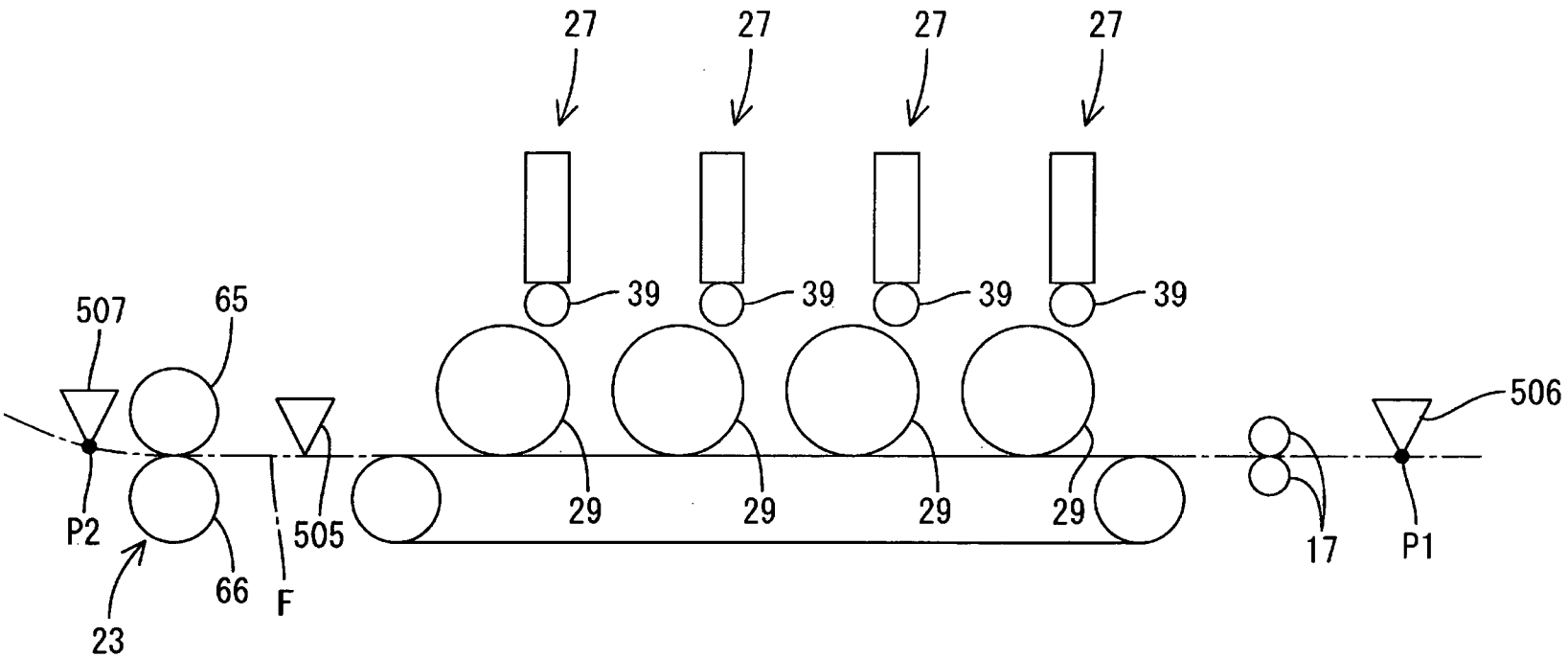
FIG. 16 is an illustration schematically showing a major portion of the laser printer in FIG. 1, and explaining the detection of a medium in the laser printer.

As schematically shown in FIG. 16, the laser printer 1 according to the present example structure includes a medium conveying belt 58 (an example of "conveying device") which conveys a medium 3 (an example of "medium for recording") along a conveyance path F, and a plurality of developing cartridges 27 (an example of image forming portion) which form an image on the medium 3 conveyed by the medium conveying belt 58. The plurality of developing cartridges 27 are arranged side by side in the conveyance direction of the medium 3 by the medium conveying belt 58.

The first sensor 506 shown in FIG. 15 and FIG. 16 is a sensor which detects the presence and absence of the medium 3 at a first position P1 at the upstream side in the conveyance direction (also hereinafter simply referred to as "upstream side") from the resist roller 17 in the conveyance path F. In the present example structure, the first sensor 506 includes a displacement member (for example, a swingable lever member) which is positioned in a first displacement state when the medium 3 does not pass through the first position P1 in the conveyance path F, and which is displaced in a second displacement state when the medium 3 is passing through the first position P1, and displacement detecting means (for example, photointerrupter or the like) which detects whether or not the displacement member is in the second displacement condition.

The first sensor 506 is also constituted so as to output a detection signal when the medium 3 is passing through the first position P1. The second sensor 507 also has the same constitution as the first sensor 506, and is constituted as a sensor which detects the presence and absence of the medium 3 at a second position P2 at the downstream side in the conveyance direction F (also hereinafter simply referred to as "downstream side") from the fixing portion 23 in the conveyance path F. The second sensor 507 is also constituted so as to output a detection signal when the medium 3 is passing through the second position P2.

Note that the first sensor 506 corresponds to an example of the upstream side sensor, and in the present example structure, the first sensor 506 corresponds to an example of the first medium detecting device. Further, the second sensor 507 corresponds to an example of the downstream side sensor, and in the present example structure, the second sensor 507 corresponds to an example of the second medium detecting device.

The present example structure includes the EEPROM 504 which stores information on the state where after the medium 3 is detected by the first sensor 506, the absence of the medium 3 is detected by the first sensor 506, and the medium 3 is not detected by the second sensor 507 at all.

That is, when the medium 3 is detected by the first sensor 506 and then the absence of the medium 3 is detected by the first sensor 506, it is confirmed that the medium 3 has passed through the first position P1. Thereafter, when the medium 3 is not detected by the second sensor 507 at all, it is apparent that the medium 3 exists between the first position P1 and the second position P2. In the present example structure, the information indicating that the medium 3 is in this state is stored in the EEPROM 504.

When the information that the medium 3 exists between the first position P1 and the second position P2 is stored in the EEPROM 504 in this way, even if a power supply interruption is caused in this state (that is, when the medium 3 exists between the two sensors), the information that the medium 3 exists between the sensors is stably stored, so as to enable an appropriate countermeasure to be taken after the power supply interruption. The flow of specific processing will be described below.

Figure 18:
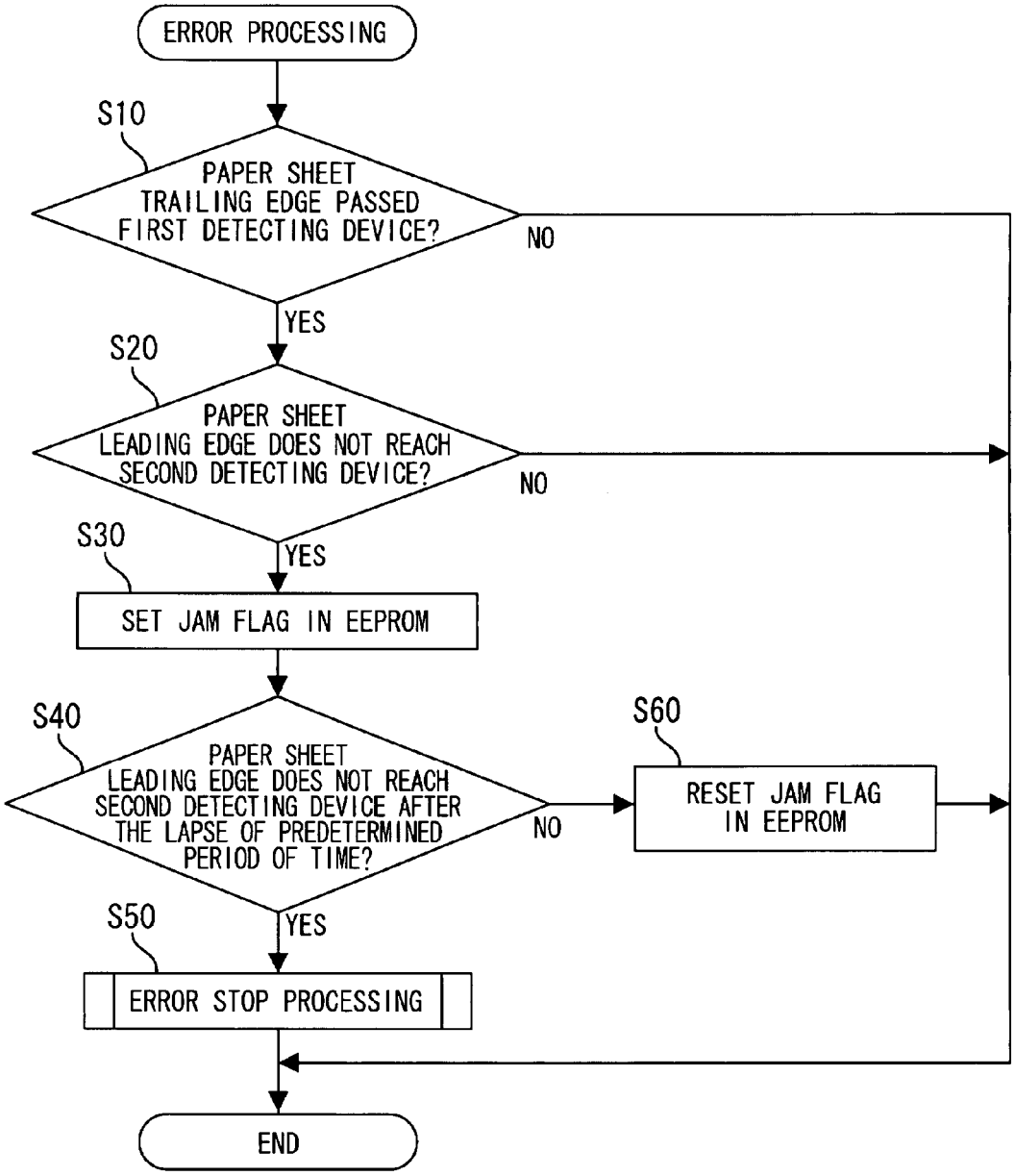
FIG. 18 is a flow chart showing an example of error processing.

FIG. 18 is a flow chart showing an example of error processing performed in the present example structure. The error processing is processing performed for every predetermined short period of time (for example, several microseconds to several tens microseconds) after the image formation is started. First, it is judged in S10 whether or not the trailing edge of the medium 3 has passed through the first medium detecting device (in the present example structure, whether or not the trailing edge of the medium 3 has passed through the first position P1 set as the detecting position by the first sensor 506 (FIG. 16)). When the trailing edge of the medium 3 has not passed through the first sensor 506, the process proceeds to branch N in S10, so that the processing is ended.

When it is judged in S10 that the medium 3 has passed through the first sensor 506, the process proceeds to branch Y in S10, and it is judged whether or not the leading edge of the medium 3 has reached the second medium detecting device (in the present example structure, whether or not the leading edge of the medium 3 has reached the second position P2 set as the detecting position by the second sensor 507 (FIG. 16)). When the leading edge of the medium 3 has reached the second sensor 507, the process proceeds to branch N in S20, so that the processing is ended.

When it is judged in S20 that the leading edge of the medium 3 has not reached the second sensor 507, the process proceeds to branch Y in S20. Then, a jam flag is set in the EEPROM 504. That is, the jam flag is a flag which is set in the state where "after the medium 3 is detected by the first sensor 506, the absence of the medium 3 is detected by the first sensor 506, and then the medium 3 is not detected at all by the second sensor 507".

Thereafter, it is judged whether or not the leading edge of the medium 3 has reached the second sensor 507 after the lapse of a predetermined period of time from the passing of the medium 3 through the first sensor 506 (S40). When the leading edge of the medium 3 has reached the second sensor 507 within the predetermined period of time after the passing of the medium 3 through the first sensor 506, the process proceeds to the branch N in S40, so that the jam flag in the EEPROM 504 is reset (S60). That is, when the leading edge of the medium 3 reaches the second sensor 507, the state where "after the medium 3 is detected by the first sensor 506, the absence of the medium 3 is detected by the first sensor 506, and then the medium 3 is not detected at all by the second sensor 507" is cancelled, and hence the jam flag is reset.

When it is judged in S40 that the leading edge of the medium 3 has not reached the second sensor 507 even after the elapse of the predetermined period of time from the passing of the medium 3 through the first sensor 506, the process proceeds to branch Y in S40, and error stop processing is performed (S50). The error stop processing is processing in which when the medium 3 does not reach the second sensor 507 within the predetermined period of time after the passing of the medium 3 through the first sensor 506 is completed (that is, the medium 3 does not reach the second position P2 within the predetermined period of time after the passing of the medium 3 through the first position P1 is completed), the image forming operation is stopped and the occurrence of error is notified.

Figure 19:
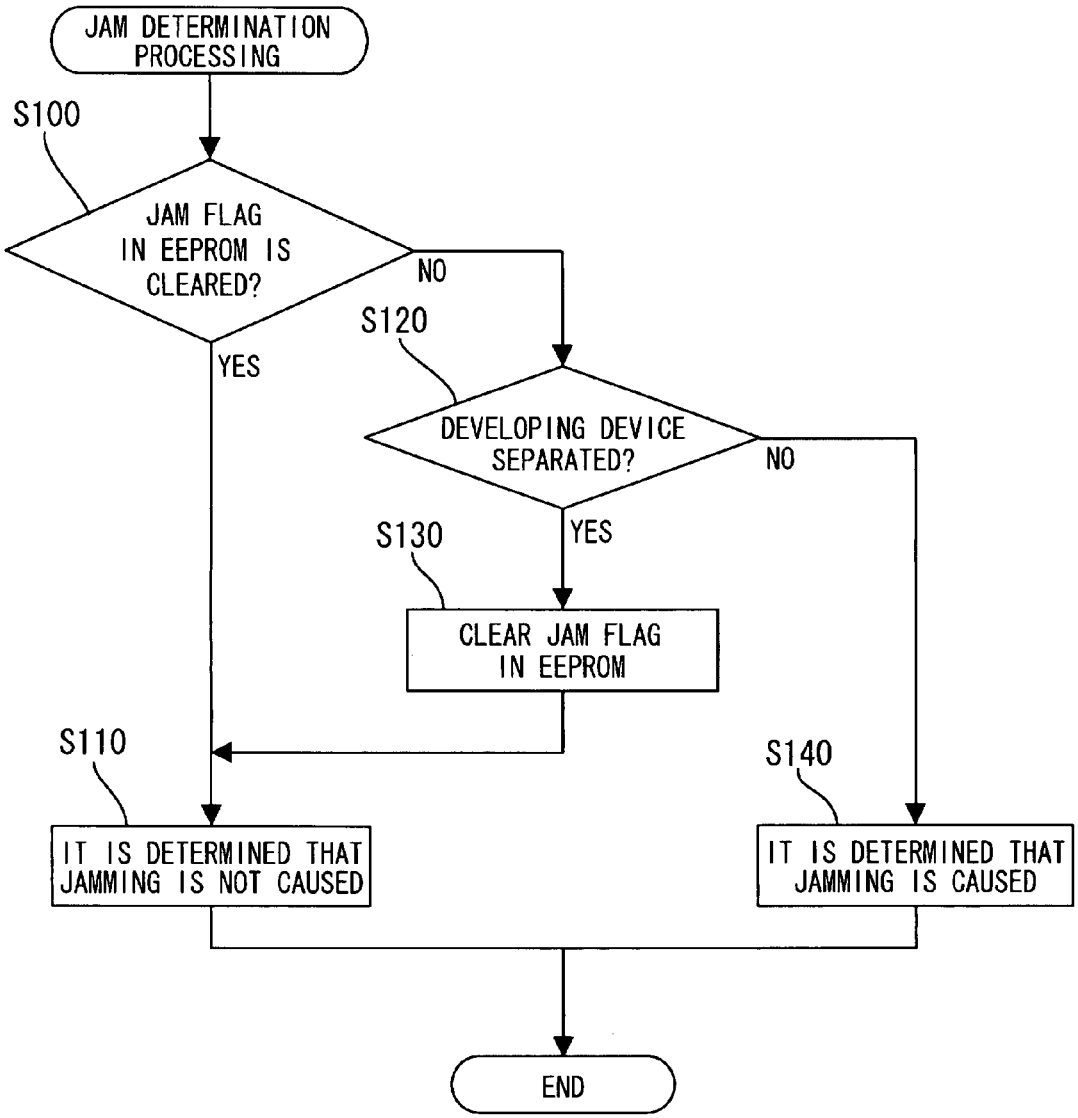
FIG. 19 is a flow chart showing an example of jam determination processing.

Next, jam determination processing will be described with reference to FIG. 19. The jam determination processing is processing which is performed at times, such as the time when the power supply is turned on, and the time when a cover (such as the front cover 9) of the laser printer 1 is closed.

First, it is judged in S100 whether or not the jam flag (the flag set in S40 (FIG. 18)) of an EEPROM 100 is cleared. When the jam flag is cleared by the above described reset operation or the like, the process proceeds to branch Y in S100, and it is judged that paper jam is not caused between the first sensor 506 and the second sensor 507 (S110).

When it is judged in S100 that the jam flag of the EEPROM 100 is not cleared, the process proceeds to branch N in S100, and it is detected by the developing device separation sensor 508 whether or not the developing rollers 39 are separated (FIG. 15). That is, in the present example structure, in the case where the jam flag is stored in the EEPROM 504 at the time when the power supply of the laser printer 1 is turned on, or the like, it is judged that the medium 3 is in a state of being stopped between the first sensor 506 and the second sensor 507 (S100). Then, when it is judged that the medium 3 is in the stopped state (in the case of N in S100), it is judged whether or not medium removing processing for removing the stopped medium 3 has been performed on the basis of the separated state of the developing rollers 39 (S120).

Then, when all the developing rollers 39 are in the separated state, the process proceeds to branch Y in S120 on the basis of the judgment that the medium removal processing has been performed, and the information (jam flag) in the EEPROM 504 is erased (S130). Then, the process proceeds to S110, and it is judged that the jam is not caused between the first sensor 506 and the second sensor 507.

On the other hand, when at least one of the developing rollers 39 is in the depressing state, the process proceeds to branch N in S120 on the basis of the judgment that the medium removal processing has not been performed, and it is judged that the jam of the medium 3 still exists between the first sensor 506 and the second sensor 507 (S140).

As described above, the present example structure includes the front cover 9 which is opened to make the conveyance path F between the first sensor 506 and the second sensor 507 accessible, and whether or not the front cover 9 is opened is detected by the developing device separation sensor 508. That is, the depressing and spacing device Sb (an example of a connection/separation device) is constituted to separate the developing roller 39 from the developing position, when the front cover 9 is opened so as to make the conveyance path F between the first sensor 506 and the second sensor 507 accessible. The developing device separation sensor 508 indirectly detects whether or not the front cover 9 is opened, by detecting whether or not the developing roller 39 is separated from the developing position. Then, in the processing, when the opening of the front cover 9 is detected by the developing device separation sensor 508, it is judged that medium removal processing was performed (S120Y).

Figure 17:
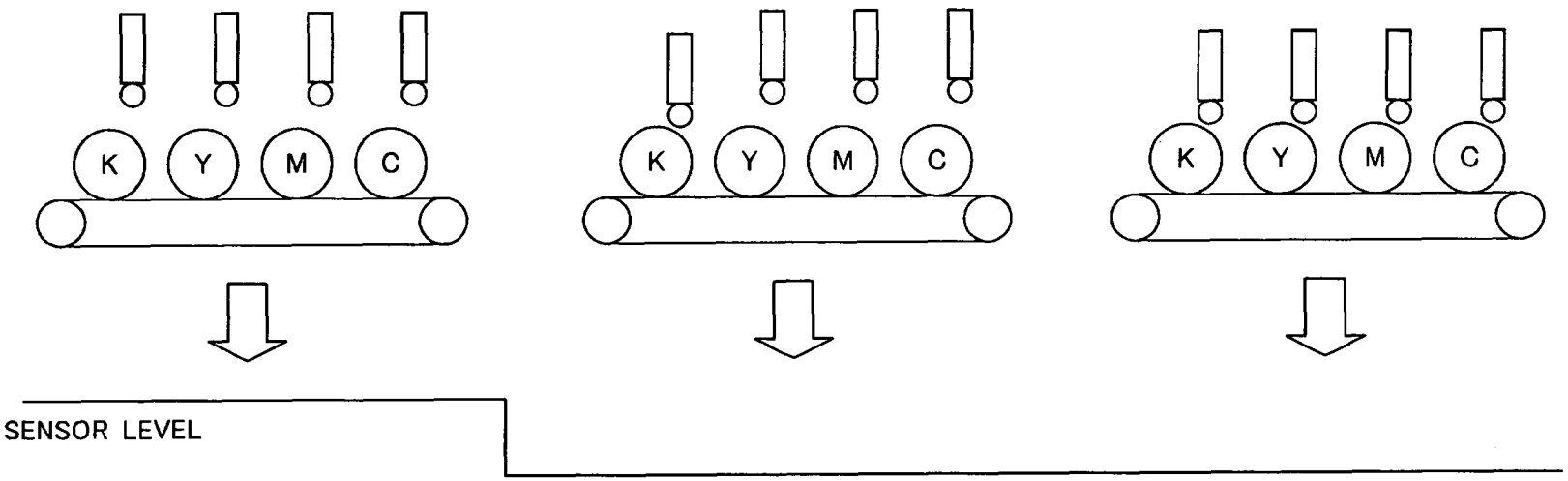
FIG. 17 is an illustration showing a relation between a displacement state of a developing roller and a sensor level of a developing device separation sensor.

Note that as described above, the depressing and spacing device Sb is constituted to move the developing roller 39 to the developing position during operation of the developing cartridge 27, and to separate the developing roller 39 from the developing position in linkage with the opening of the front cover 9. On the other hand, as shown in FIG. 17, the developing device separation sensor 508 is constituted to output a separation detection signal when all the developing rollers 39 are in the separated state, (in the state at the left end in FIG. 17), and to output a separation non-detection signal when at least one of the developing rollers 39 is in the developing position (in the state of the center or the right end in FIG. 17). When the separation detection signal is outputted from the developing device separation sensor 508, the process proceeds to branch Y in S120, while when the separation non-detection signal is outputted, the process proceeds to branch N in S120.

Further, the laser printer 1 according to the present example structure is constituted in such a manner that when it is judged in S140 that the jamming is caused (in other words, when the information (jam flag) is stored in the EEPROM 504 at the time of turning on the power supply, or the like, and is not erased), the stop information that the medium 3 is stopped in the conveyance path F is notified. In the present example structure, the CPU and the display portion 509 (FIG. 15) correspond to an example of the notifying device. The notification can be performed by displaying comment information that "jamming is caused" or the like on the display portion 509, or by emitting a predetermined buzzer sound. Note that also when at least one of the first sensor 506 and the second sensor 507 has detected the medium 3 at the time of turning on the power supply, or the like, in the processing other than that in FIG. 19, the stop information that the medium 3 is stopped in the conveyance path F is rendered to be notified.

Further, when it is judged in S140 that the jamming is caused (when the information (jam flag) is stored in the EEPROM 504 and is not erased at the time of turning on the power supply of the laser printer 1, or the like), the image forming operation (including an operation preparatory to the image forming operation) by the respective developing cartridges 27 and the like is inhibited.

As described above, the constitution according to the present example structure includes the EEPROM 504 which stores the information that after the medium 3 is detected by the first sensor 506, the absence of the medium 3 is detected by the first sensor 506, and the medium 3 is not detected by the second sensor 506 at all. Therefore, in the constitution according to the present example structure, it is possible to stably store the information for confirming that the medium 3 exists between the first sensor 506 and the second sensor 507, as a result of which it is possible to effectively prevent the failure that the state where the medium 3 exists between the two sensors 506 and 507 is reset (for example, the power supply interruption of the image forming apparatus), and thus to continuously and appropriately grasp the state where the medium 3 is stopped between the two sensors 506 and 507.

Further, at the time of turning on the power supply of the laser printer 1, or the like, in the case where the information (jam flag) is stored in the EEPROM 504, or where at least one of the first sensor 506 and the second sensor 507 detects the medium 3, the stop information that the medium 3 is stopped in the conveyance path F is rendered to be notified by the cooperation of the display portion 509 and the CPU 501. Therefore, it is possible to surely confirm that the medium 3 is stopped in the conveyance path F at the time of turning on the power supply, and to notify this state to the user.

Further, when the information (jam flag) is stored in the EEPROM 504 at the time of turning on the power supply of the laser printer 1, the image forming operation or the operation preparatory to the image formation is inhibited. Therefore, it is possible to stably store the confirmation information obtained by confirming that the medium 3 exists between the first sensor 506 and the second sensor 507, and to effectively prevent the failure that the image forming operation or the operation preparatory to the image formation is performed in the state where the medium 3 exists between the two sensors 506 and 507.

Further, when the medium 3 is judged to be in the stopped state, it is judged whether or not the medium removal processing is performed for the medium 3 in the stopped state. When it is judged that medium removal processing is performed, the information (jam flag) in the EEPROM 504 is rendered to be erased. Therefore, the information (jam flag) can be stably stored until the medium removal processing of the stopped state is performed. On the other hand, when the medium removal processing for the jamming is performed, the restoration from the stopped state is suitably performed so that the image forming operation and the operation preparatory to the image formation are preferably performed.

Further, the front cover 9 which is opened to make the conveyance path F between the first sensor 506 and the second sensor 507 accessible, and the developing device separation sensor 508 which detects whether or not the front cover 9 is opened are provided, whereby when the opening of the front cover 9 is detected by the developing device separation sensor 508 (when the developing device separation sensor 508 indirectly detects the opening of the front cover 9 by detecting the separation of all the developing rollers 39), it is judged that the medium removal processing is performed. This makes it possible to suitably grasp whether or not the medium removal processing for the stopped state is performed.

Further, the depressing and spacing device Sb which moves the developing roller 39 to the developing position during operation of the developing cartridge 27 and the like, and makes the developing roller 39 separated from the developing position in linkage with the opening of the front cover 9, is provided, and the developing device separation sensor 508 indirectly detects the opening of the front cover 9 by detecting whether or not the developing roller 39 is separated from the developing position. Therefore, it is possible to realize a constitution which enables the developing roller 39 to be smoothly connected and separated, and to simply grasp whether or not the medium removal processing for the stopped state is performed, by utilizing the depressing and spacing device Sb.

The depressing and spacing device Sb is constituted to make the developing roller 39 separated from the developing position at the time when the front cover 9 is opened so as to make the conveyance path F between the first sensor 506 and the second sensor 507 accessible. When the front cover 9 is opened so as to make the conveyance path F between the first sensor 506 and the second sensor 507 accessible in this way, the probability that the medium 3 has been removed is high. Thus, in the present example structure, whether or not the medium removal processing for the stopped state has been performed is simply and accurately judged by utilizing the opened state of the front cover 9.

Further, the first sensor 506 consists of an upstream sensor provided on the upstream side from the image forming position in the conveyance direction of the medium 3 by the medium conveyance belt 58, and the second sensor 507 consists of a downstream sensor provided on the downstream side from the image forming position in the conveyance direction, which sensors constitute a preferred example capable of detecting the stopped state of the medium 3 during image formation.

Further, as in the present example structure, in the case of the laser printer 1 in which a plurality of developing cartridges 27 are arranged side by side in the conveyance direction of the medium 3, the conveyance path F between the two sensors 506 and 507 tends to become long, which easily causes the mediums 3 to be stopped between the two sensors 506 and 507. Therefore, as in the present invention, it is effective to stably store the information in the EEPROM 504.

Figure 20:
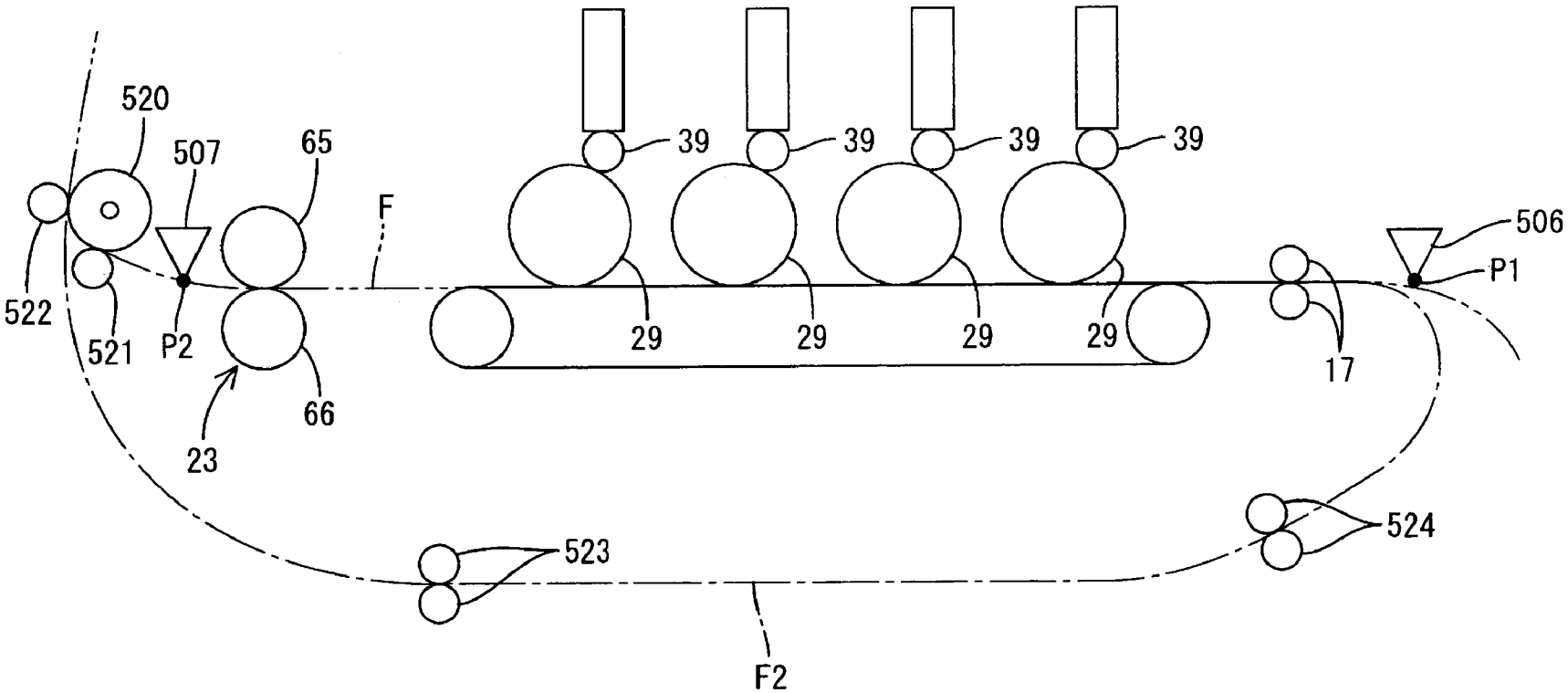
FIG. 20 is an illustration schematically showing a major portion of a laser printer according to example structure 2, and illustrating the detection of a medium in the laser printer.

Next, another example structure according to the present invention will be described with reference to FIG. 20. The present example structure is different from the above described example structure in that a conveyance path F2 for double-side printing and conveying devices for double-side printing (rollers 520, 521, 522, 523 and 524), are provided in order to convey the medium 3, which passed the second sensor 507 as the downstream sensor, to the upstream side from the first sensor 506 as the upstream sensor, and in that the second sensor 507 is used as the first medium detecting device, and the first sensor 506 is used as the second medium detecting device. As for the figures, FIG. 20 corresponds to FIG. 16 of the above described example structure. The constitution of the present example structure can be obtained by adding the conveyance path F2 for double-side printing and the conveying devices for double-side printing (rollers 520, 521, 522, 523 and 524) to the constitution shown in FIG. 1 to FIG. 19, and hence the explanation will be made with reference FIG. 20 and not to FIG. 1 to FIG. 19. Note that since the structure of the conveying device for double-side printing is known and various other known structures may also be adopted, the detailed explanation of the structure is omitted.

In the present example structure, the information that after the medium 3 is detected by the second sensor 507, the absence of the medium 3 is detected by the second sensor 507, and thereafter, the medium 3 is not detected by the first sensor 506 at all, is stored in the EEPROM 504 (EEPROM 504 corresponds to an example of a nonvolatile storage device). That is, when after the medium 3 is detected by the second sensor 507, the absence of the medium 3 is detected by the second sensor 507, it is confirmed that the medium 3 has passed the first position P2. Thereafter, when the medium 3 is not detected by the first sensor 506 at all, it becomes apparent that the medium 3 exists in the conveyance path for double-side printing F2 between the second position P2 and the first position P1. In the present example structure, the information indicating that the medium 3 is in this state is stored in the EEPROM 504.

In this way, when the information on the state where the medium 3 exists in the conveyance path F2 between the second position P2 and the first position P1 is rendered to be stored in the EEPROM 504, even if a power supply interruption of the image forming apparatus is caused in the state (that is, when the medium 3 exists in the conveyance path F2 between the two sensors), it is possible to stably store the information that the medium 3 exists between the sensors, and to take appropriate measures after the power supply interruption.

According to the constitution of the present example structure, an apparatus having a double-side printing function is enabled to preferably detect the stopped state of the medium 3 in the conveyance path F2 for double-side printing, and to continuously and suitably grasp the stopped state. Further, the conveyance path F2 for double-side printing is constituted to convey the medium 3 which has passed the downstream sensor, to the upstream side from the upstream sensor. Thereby, the conveyance path tends to become long, to easily cause the medium 3 to be stopped between the second sensor 507 as the first medium detecting device and the first sensor 506 as the second medium detecting device. Therefore, as in the present invention, it is further effective to stably store the information in the EEPROM 504.

The present invention is not limited to the example structures described by the above description with reference to the accompanying drawings, and for example, a following example structure is also included in the technical scope of the present invention.

In the above described example structures, an example of the first sensor 506 and the second sensor 507 is described, but the sensor is not limited to the above described example structure, provided that the sensor is capable of detecting the presence and absence of the medium 3 in the first position and the second position. For example, both of the first sensor 506 and the second sensor 507 can be substituted by transmission type or reflection type photoelectric sensors which detect the medium by using a light emitting element and a light receiving element.

What is claimed is:

1. An image forming apparatus comprising:

a conveying device configured to convey a recording medium along a conveyance path;

an image forming portion configured to form an image on the recording medium conveyed by the conveying device and placed at an image forming position;

a first sensor configured to detect the recording medium at a first position located on an upstream side in the conveyance path relative to the image forming;

a second sensor configured to detect the recording medium at a second position located on a downstream side in the conveyance path relative to the image forming position;

a nonvolatile memory; and a processor configured to:

perform a first judgment to determine whether a trailing edge of the recording medium is detected by the first sensor and the recording medium is detected by the second sensor;

store data regarding occurrence of a jam in the nonvolatile memory if a result of the first determination indicates that the trailing edge of the recording medium is detected by the first sensor and the recording medium is not detected by the second sensor;

perform a second judgment to determine whether the recording medium is detected by the second sensor within a predetermined period after the recording medium is detected by the first sensor; and erase the data regarding occurrence of a jam from the nonvolatile memory if a result of the second judgment indicates that the recording medium is detected by the second sensor within the predetermined period.

2. The image forming apparatus according to claim 1, further comprising a notifying device configured to send a signal that the recording medium is stopped in the conveyance path when the data regarding occurrence of a jam is stored in the nonvolatile memory at a time of turning on a power supply of the image forming apparatus.

3. The image forming apparatus according to claim 2, wherein the notifying device is configured to send a signal that the recording medium is stopped in the conveyance path when at least one of the first sensor and the second sensor detects the recording medium at the time of turning on the power supply of the image forming apparatus.

4. The image forming apparatus according to claim 1, further comprising an operation inhibiting device configured to inhibit an image forming operation by the image forming portion, when the data regarding occurrence of a jam is stored in the nonvolatile memory at the time of turning on a power supply of the image forming apparatus.

5. The image forming apparatus according to claim 2, further comprising an operation inhibiting device configured to inhibit an image forming operation by the image forming portion, when the data regarding occurrence of a jam is stored in the nonvolatile memory at the time of turning on the power supply of the image forming apparatus.

6. The image forming apparatus according to claim 1, further comprising:

a medium removal processing detecting device configured to detect whether removal of the recording medium stopped between the first sensor and the second sensor is performed; and an information erasing device configured to erase the data regarding occurrence of a jam stored in the nonvolatile memory if the data is stored in the nonvolatile memory at the time of turning on a power supply of the image forming apparatus and the removal of the recording medium is detected by the medium removal processing detecting device.

7. The image forming apparatus according to claim 6, further comprising an opening and closing member configured to provide a user with an access to the conveyance path between the first sensor and the second sensor, wherein the medium removal processing detecting device is configured to detect the removal of the recording medium on the basis of detection of opening of the opening and closing member.

8. The image forming apparatus according to claim 7, further comprising a connecting and separating device, wherein:

the image forming portion includes a developing device configured to develop an image on the recording medium the connecting and separating device is configured to move the developing device to a developing position during operation of the image forming portion, and to separate the developing device from the developing position based on the opening of the opening and closing member, and the medium removal processing detecting device detects the removal of the recording medium on the basis of the developing device being separated from the developing position.

9. The image forming apparatus according to claim 8, wherein the connecting and separating device is configured to separate the developing device from the developing position at the time when the opening and closing member is opened.

10. The image forming apparatus according to claim 1, wherein the conveyance path is configured for double-side printing to convey the recording medium passing through the second sensor, to the upstream side relative to the first sensor.

11. The image forming apparatus according to claim 1, wherein a plurality of image forming portions are arranged side by side in the conveyance path.

12. The image forming apparatus according to claim 10, wherein a plurality of image forming portions are arranged side by side in the conveyance path.

* * * * *